US008230550B2

(12) United States Patent
Krebs et al.

(10) Patent No.: US 8,230,550 B2
(45) Date of Patent: Jul. 31, 2012

(54) ACCESSORY TOOL FOR A VACUUM CLEANER

(75) Inventors: Alan J. Krebs, Pierson, MI (US); Douglas J. Medema, Belding, MI (US); Jonathan L. Miner, Rockford, MI (US); Tom Minh Nguyen, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 1151 days.

(21) Appl. No.: 12/041,007

(22) Filed: Mar. 3, 2008

(65) Prior Publication Data

US 2008/0216273 A1 Sep. 11, 2008

Related U.S. Application Data

(60) Provisional application No. 60/893,033, filed on Mar. 5, 2007.

(51) Int. Cl.
*A47L 7/00* (2006.01)
*A47L 9/00* (2006.01)

(52) U.S. Cl. ..... 15/344; 15/353; 15/246.2; 15/320

(58) Field of Classification Search ..... 15/246.2, 15/344, 320, 322, 347, 353, 429, DIG. 3; *A47L 7/00, A47L 9/00*

See application file for complete search history.

(56) References Cited

U.S. PATENT DOCUMENTS

| | | | |
|---|---|---|---|
| 4,179,769 | A | 12/1979 | Lundquist |
| 5,263,224 | A | 11/1993 | Lovelady |
| 5,377,383 | A | 1/1995 | Christensen |
| 5,634,238 | A | 6/1997 | McCaffrey et al. |
| 5,839,154 | A | 11/1998 | Kawai et al. |
| 5,974,624 | A | 11/1999 | Eisen |
| 6,021,545 | A | 2/2000 | Delgado et al. |
| 6,324,723 | B1 | 12/2001 | Dodson et al. |
| 6,517,596 | B2 | 2/2003 | Dodson et al. |
| 6,687,952 | B1 | 2/2004 | Mohan, Jr. |
| 2002/0092117 | A1 | 7/2002 | Kasper et al. |
| 2005/0125921 | A1 | 6/2005 | Leonard |
| 2006/0260089 | A1 | 11/2006 | Hammond |

FOREIGN PATENT DOCUMENTS

| | | |
|---|---|---|
| GB | 1190219 | 4/1970 |
| JP | 2003293986 | 10/2003 |
| WO | 9212664 A1 | 8/1992 |
| WO | 2008078238 | 7/2008 |

*Primary Examiner* — David Redding
(74) *Attorney, Agent, or Firm* — McGarry Bair PC

(57) ABSTRACT

An accessory tool according to the present invention comprises a recovery tank assembly for removing fluid and dirt from a surface to the cleaned and storing the recovered fluid and dirt. The recovery tank assembly comprises a suction nozzle in fluid communication with a recovery tank. The accessory tool further comprises a fan/turbine assembly including a turbine-driven suction fan for generating suction at the suction nozzle, which draws liquid and air into and through the accessory tool. The turbine-driven suction fan can be magnetically coupled with the turbine. The accessory tool can further comprise a fluid dispensing assembly for storing and distributing fluid to the surface to the cleaned. The fluid dispensing assembly can comprise a turbine-driven fluid pump. The accessory tool can further comprise an agitator assembly that can be moved from a use to a non-use orientation to allow the accessory tool to alternately be used for scrubbing the surface to the cleaned and for extracting fluid from the surface to be cleaned. The recovery tank can further comprise a rotating outlet conduit with an inlet opening that will have an upward orientation when the recovery tank is tilted.

13 Claims, 23 Drawing Sheets

ACCESSORY TOOL FOR A VACUUM CLEANER

CROSS-REFERENCE TO RELATED APPLICATION

This application is related to U.S. Provisional Patent Application No. 60/893,033, filed Mar. 5, 2007, which is incorporated herein by reference in its entirety.

BACKGROUND OF THE INVENTION

1. Field of the Invention

The present invention relates generally to an accessory tool for a vacuum cleaner, and more specifically, to a fluid distribution and recovery tool.

2. Description of the Related Art

Vacuum cleaning appliances are known for removing dry or wet debris from surfaces, including fabric-covered surfaces like carpets and upholstery, and bare surfaces like hardwood, linoleum and tile. Conventional dry vacuum cleaners are not capable of distributing or recovering fluids from surfaces because moisture can damage the motor and filtration system of the vacuum cleaner. As a result, liquid extraction vacuum cleaning appliances such as vacuum mops, extractors and carpet cleaners must be used to distribute and/or remove liquids from surfaces requiring a consumer to keep several large pieces of equipment available to complete different floor cleaning needs.

Various attachments have been developed to adapt conventional dry vacuum cleaners to distribute and recover liquids. Many of these attachments only allow for fluid recovery, and are not provided with means for fluid distribution. Some attachments include replacement filter systems that can collect recovered fluid. Other attachments include hand-held accessory tools, often referred to as wet or wet pick-up tools, that are coupled to the conventional dry vacuum cleaner using a vacuum hose.

A noted problem with using a wet pick-up tool to convert a conventional dry vacuum cleaner into one capable of fluid distribution and/or recovery is preventing fluid from entering the filtration system and suction source of the vacuum cleaner. Accordingly, wet pick-up tools often include means for separating working air from recovered fluid and a container for collecting the recovered fluid so that fluid is prevented from passing, along with the working air, to the conventional dry vacuum cleaner through the vacuum hose. However, if the container is overfilled or turned to an unusual angle, known wet pick-up tools can allow fluid to remain in the working air and enter the conventional dry vacuum cleaner, causing damage to the filtration system and suction source.

SUMMARY OF THE INVENTION

According to one embodiment of the invention, an accessory tool comprises a housing having a suction opening adapted to be connected to a vacuum hose, a suction nozzle, a recovery tank in fluid communication with the suction nozzle, a turbine rotatably mounted within a turbine chamber having an inlet opening in fluid communication with the atmosphere and an outlet opening connected to the suction opening for rotatably driving the turbine with suction from the vacuum hose, a suction fan rotatably mounted within a suction fan chamber having an inlet opening in fluid communication with the suction nozzle through the recovery tank for depositing fluid that is drawn in through the suction nozzle into the recovery tank and an outlet opening in fluid communication with the atmosphere and a coupling between the turbine and the suction fan, whereby the turbine drives the suction fan when suction is applied at the suction opening.

According to another embodiment of the invention, a floor cleaning implement comprises a suction nozzle adapted to be connected to a source of suction and an agitator assembly associated with the suction nozzle for pivotal movement between a first position in which the agitator is in contact with a surface to be cleaned and the suction nozzle is spaced from the surface to be cleaned, and a second position in which the suction nozzle is in contact with the surface to be cleaning and the agitator is spaced from the surface to be cleaned.

According to yet another embodiment of the invention, an accessory tool for use in connection with a vacuum cleaner comprises a housing having a suction opening adapted to be connected to a source of suction, a suction nozzle, a recovery tank in fluid communication with the suction nozzle and an outlet conduit mounted for rotation within the recovery tank about an axis of rotation and having an inlet opening in fluid communication with the recovery tank and an outlet opening in fluid communication with the source of suction, wherein the outlet conduit is constructed to rotate so that the inlet opening will have a upward orientation when the axis of rotation is non-vertical and so that the inlet opening will be above a level of fluid in the recovery tank.

According to still another embodiment the invention, a floor cleaning implement comprises a suction nozzle, a fan in fluid communication with the suction nozzle, a motor for driving the fan and a magnetic coupling between the fan and the motor.

DESCRIPTION OF THE PREFERRED EMBODIMENT

Figure 1:
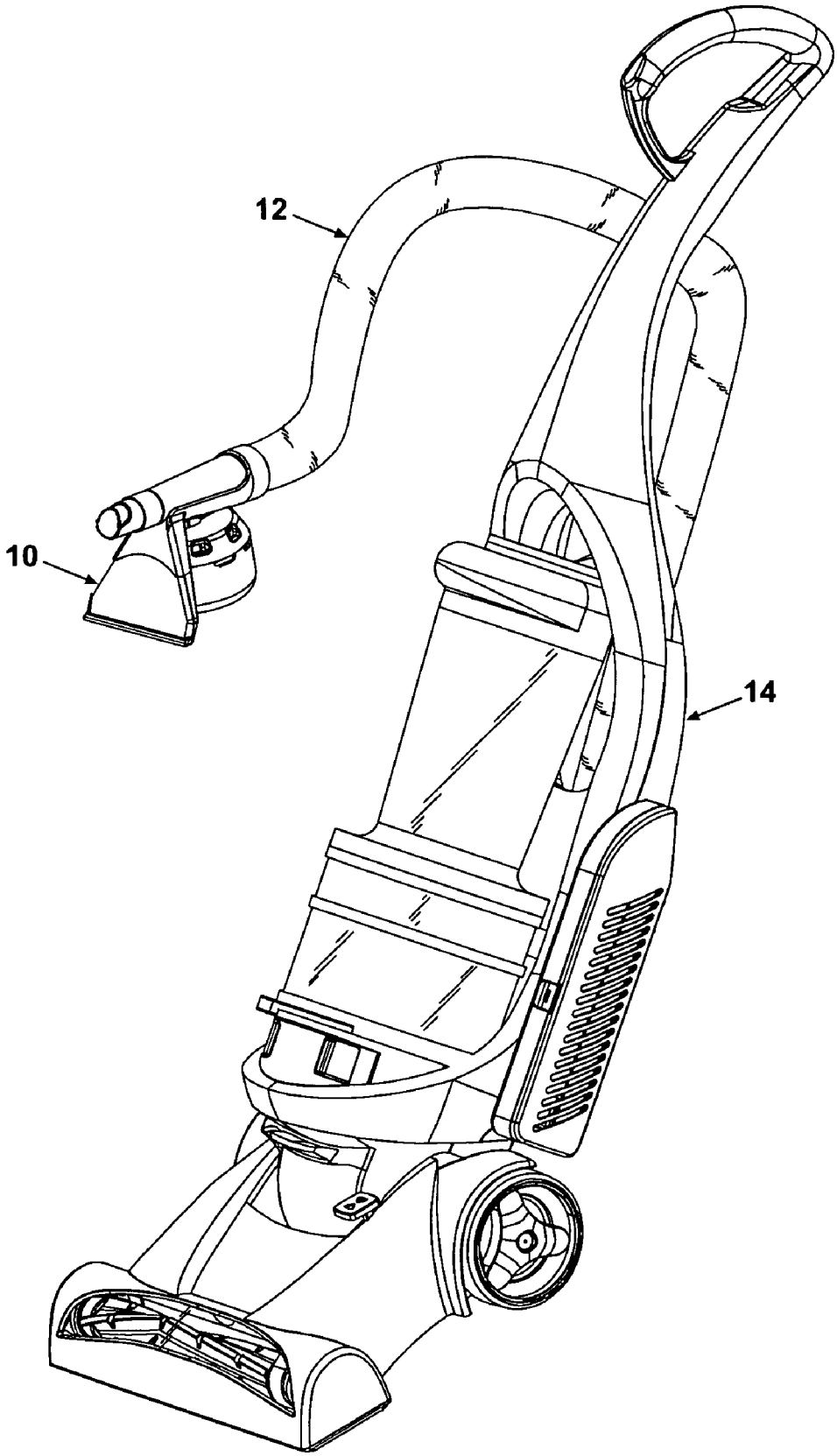
FIG. 1 is a perspective view of a first embodiment of an accessory tool according to the present invention connected to a vacuum hose that is coupled with a conventional dry vacuum cleaning appliance.

Referring to the drawings, and in particular to FIG. 1, a first embodiment of an accessory tool 10 according to the present invention is illustrated that comprises a fluid delivery system for storing cleaning fluid and delivering the cleaning fluid to a surface to the cleaned, and a fluid recovery system for removing the spent cleaning fluid and dirt from the surface to the cleaned and storing the spent cleaning fluid and dirt. The accessory tool 10 is configured for removable mounting to a vacuum hose 12, which is in turn coupled with a source of suction. Preferably, the source of suction is a conventional dry vacuum cleaner 14; however any commonly known vacuum cleaning appliance comprising a suction source and vacuum hose is acceptable. As used herein, the term "dry vacuum cleaner" is used to denote a floor surface cleaner that is not capable of fluid distribution or fluid recovery without the accessory tool 10, unless it is specifically stated otherwise. Furthermore, the accessory tool 10 can be utilized with other vacuum cleaning appliances, such as a wet carpet cleaner or liquid extractor.

The vacuum cleaner 14 can comprise any type of vacuum cleaner utilizing a vacuum hose, such as an upright, canister, stick-type, or hand-held vacuum cleaner, or with a built-in central vacuum cleaning system. Further, the vacuum cleaner 14 can be used to clean fabric-covered surfaces, such as carpets and upholstery, or bare surfaces, such as hardwood, linoleum, and tile. The vacuum cleaner 14 draws in dirt-laden air through the hose 12 and into a filtration system where the dirt is trapped for later disposal. Exemplary filtration systems can include a filter bag or a bagless cyclonic filter. As illustrated, the vacuum cleaner 14 comprises an upright vacuum cleaner using at least a cyclone separator as the filtration system. Details of a suitable vacuum cleaner for use with the accessory tool 10 are disclosed in commonly assigned U.S. Pat. No. 6,810,557 to Hansen et al.

Figure 2:
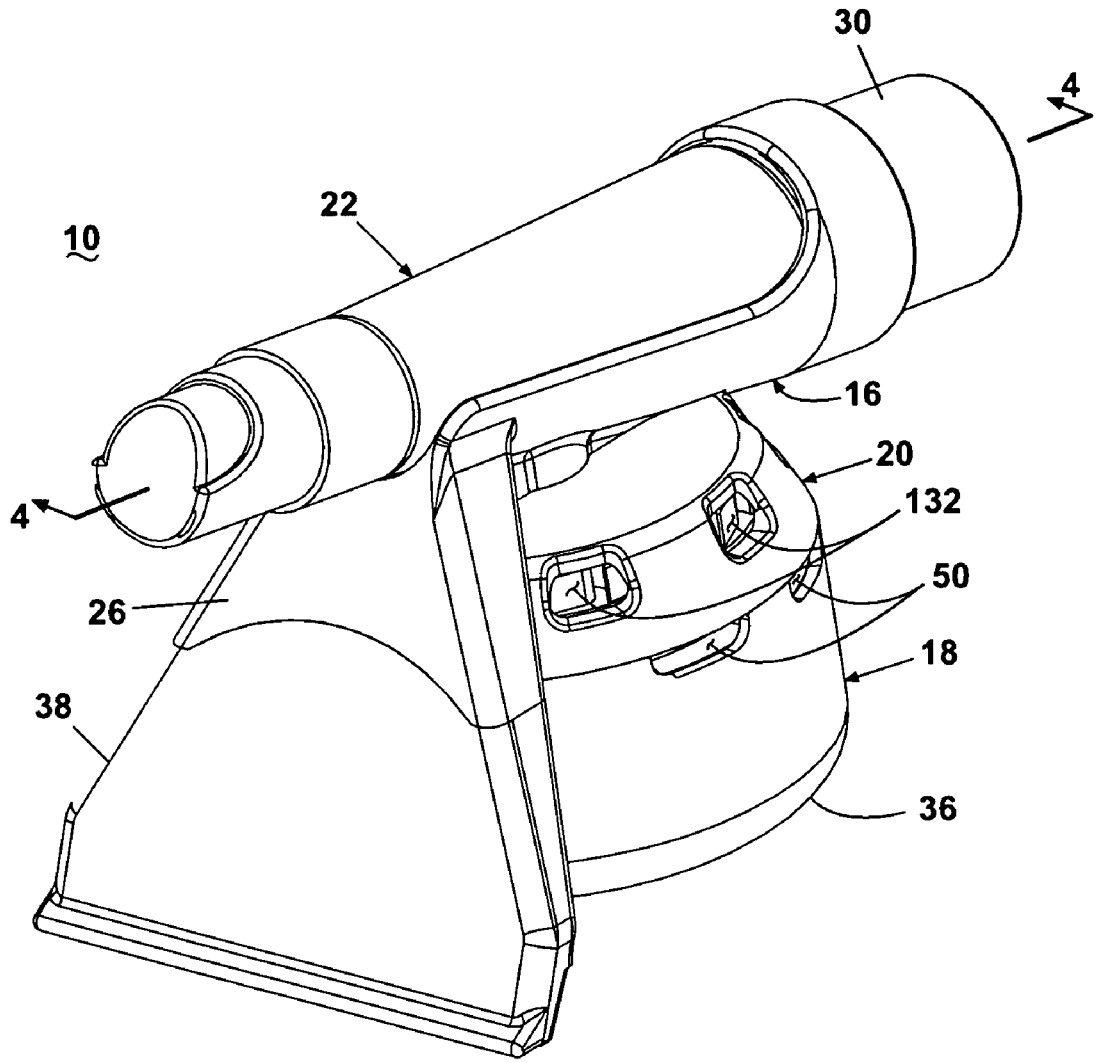
FIG. 2 is a perspective view of the accessory tool, showing a tool body supporting a recovery tank assembly and a fan/turbine assembly at a lower portion thereof and a fluid dispensing system at an upper portion thereof.
Figure 3:
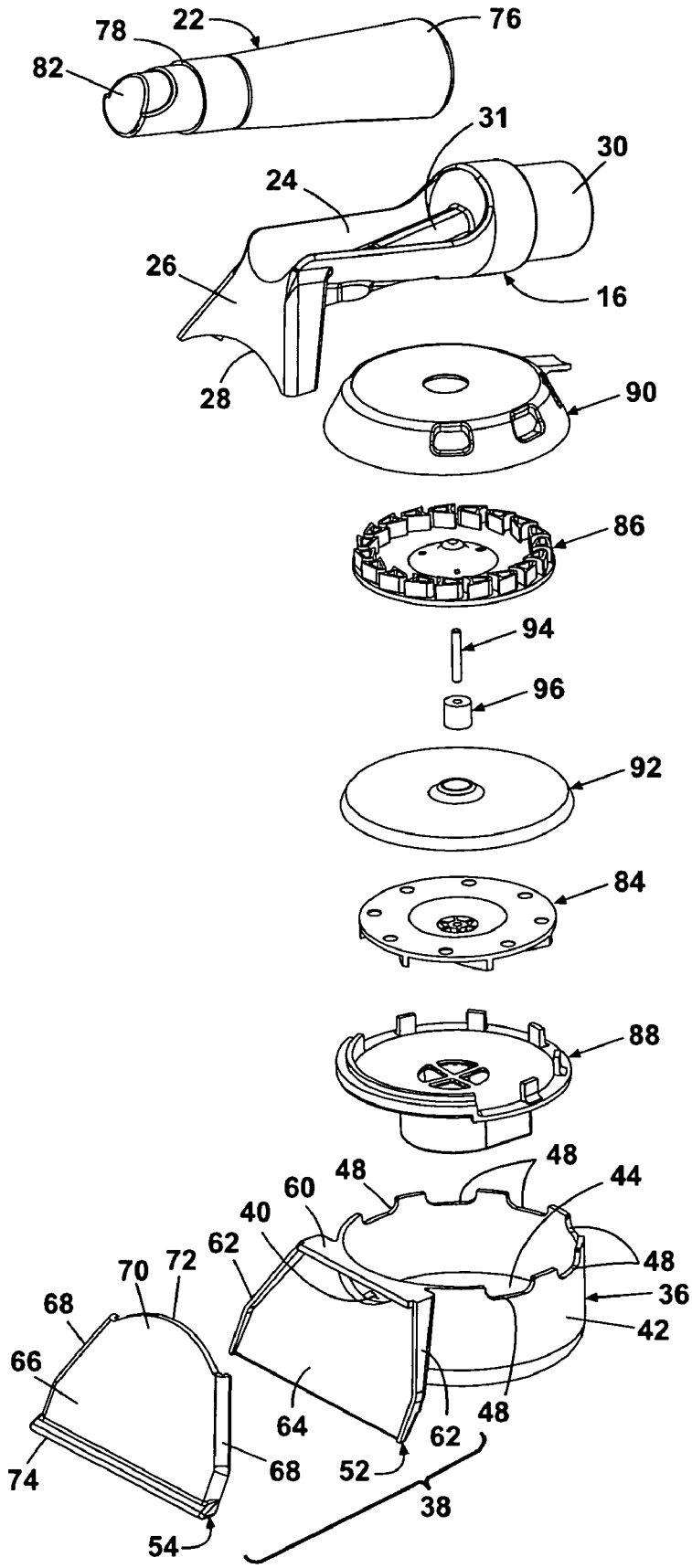
FIG. 3 is an exploded view of the accessory tool from FIG. 2.
Figure 4:
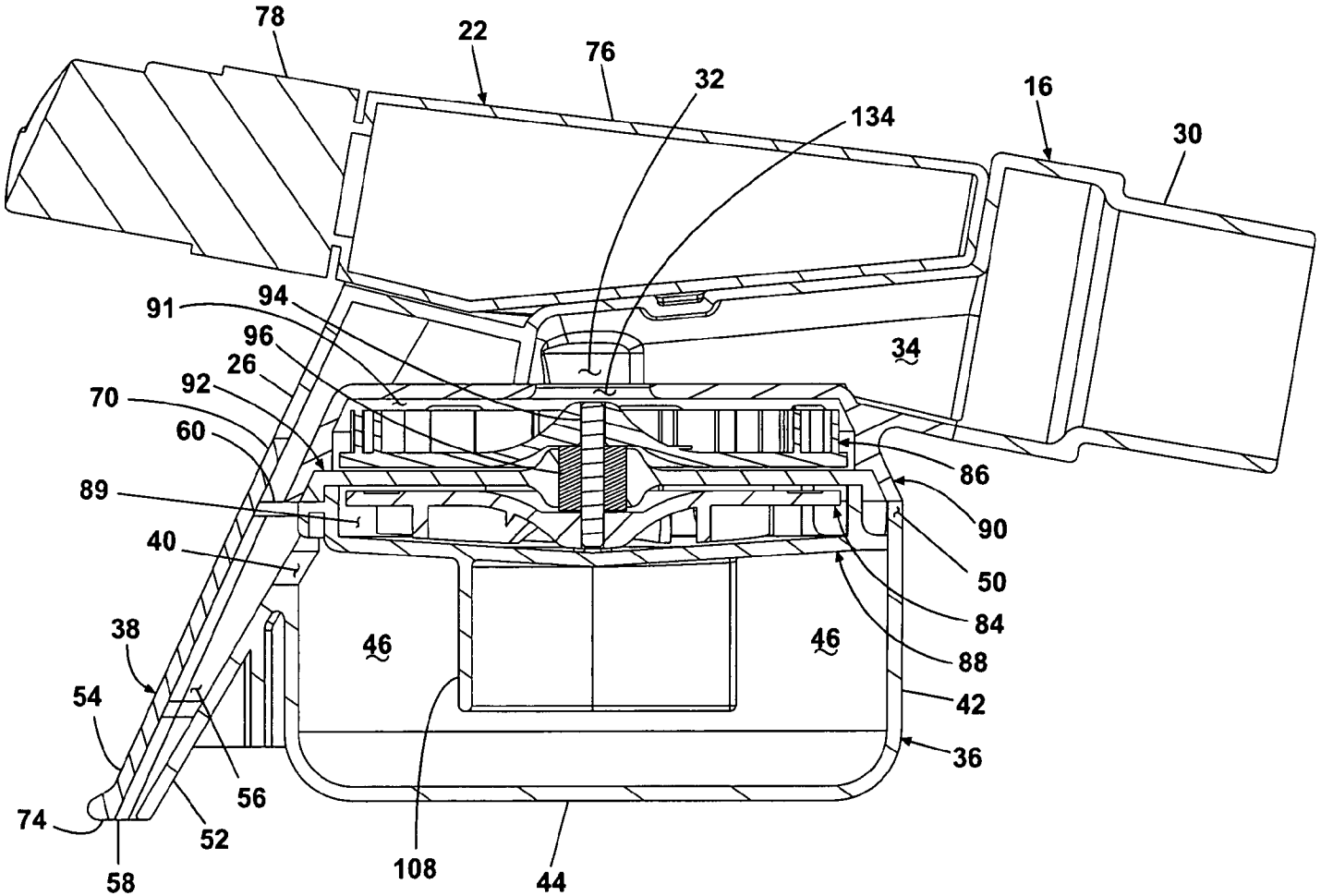
FIG. 4 is a sectional view taken through line 4-4 of FIG. 2.

Referring to FIGS. 2-4, the accessory tool 10 comprises a tool body 16 that removably supports a recovery tank assembly 18 and a fan/turbine assembly 20 at a lower portion thereof, lower being defined as relative to the typical use position of the accessory tool 10, and a fluid dispensing assembly 22 at an upper portion thereof. The recovery tank assembly 18 stores recovered cleaning fluid and dirt, while the fluid dispensing assembly 22 stores cleaning fluid before it is distributed to the surface to be cleaned. The recovery tank assembly 18 can further comprise an air/liquid separator from separating air from recovered cleaning fluid and dirt. The cleaning fluid can comprise any suitable cleaning fluid, including, but not limited to, water, concentrated detergent, diluted detergent, and the like. The fan/turbine assembly 20 is generally positioned between the tool body 16 and the recovery tank assembly 18 and is used generate fluid and air flow through the accessory tool 10.

Figure 5A:
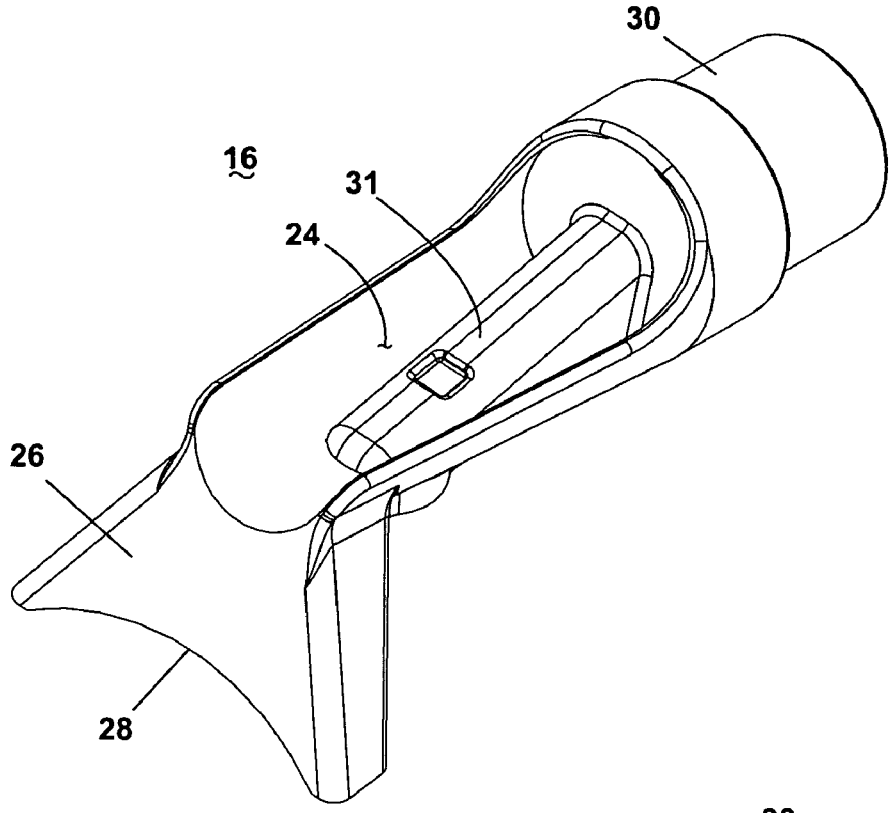
FIG. 5A is a top perspective view of the tool body from FIG. 2.
Figure 5B:
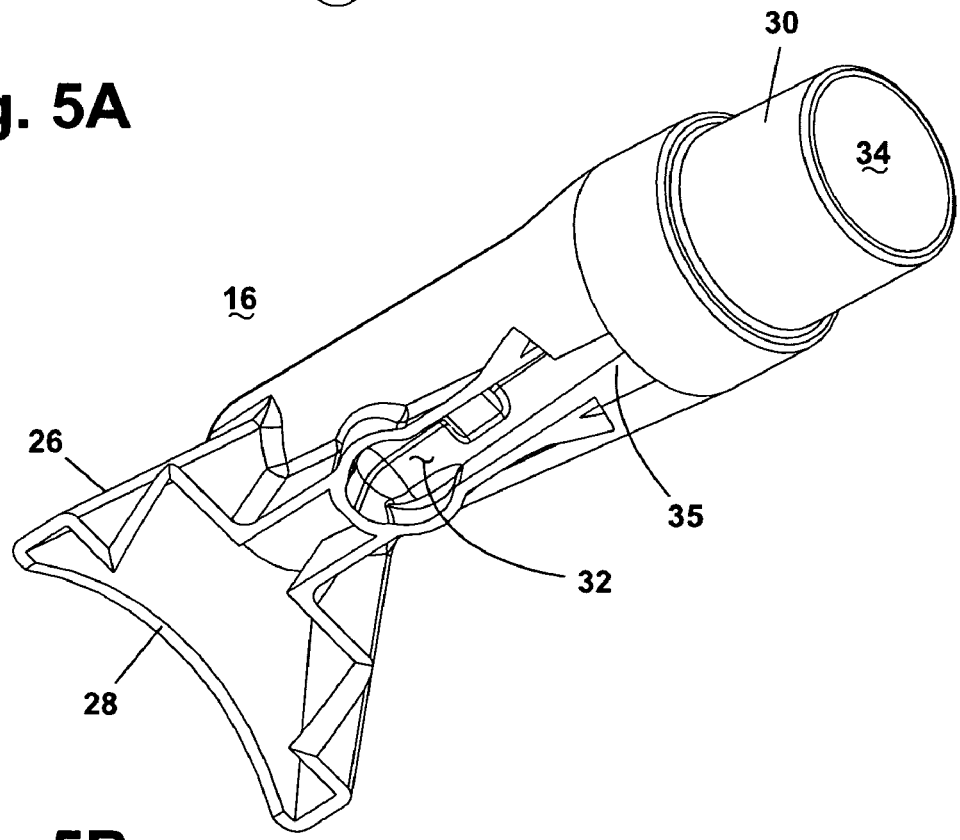
FIG. 5B is a bottom perspective view of the tool body from FIG. 2.

Referring to FIGS. 3, 5A, and 5B, the tool body 16 comprises a fluid dispensing assembly receiver 24 that removably mounts the fluid dispensing assembly 22 positioned on an upper portion of the tool body 16, a nozzle receiver 26 having an arcuate lower surface 28 positioned at a forward end of the tool body 16, and a hollow hose connector 30 positioned at a rear end of the tool body 16, opposite the nozzle receiver 26. The fluid dispensing assembly receiver 24 at least partially receives the fluid dispensing assembly 22 and can comprise a retaining feature, such as a ridge 31 that retains a portion of the fluid dispensing assembly 22 within the fluid dispensing assembly receiver 24. The hose connector 30 is configured to fluidly couple with the vacuum hose 12, or another accessory tool (not shown), such as an extension pipe coupled with the vacuum hose 12. Furthermore, the hose connector 30 provides a convenient place for the user to grip the accessory tool 10. A working air conduit inlet opening 32 is formed on a lower surface of the tool body 16, opposite the fluid dispensing assembly receiver 24 and is in fluid communication with the fan/turbine assembly 20. A working air conduit 34 is formed through the tool body 16 and extends between the working air conduit inlet opening 32 and the hose connector 30. Thus, the working air conduit 34 fluidly communicates with a source of suction, such as the vacuum cleaner 14, via the vacuum hose 12, or another accessory tool. A turbine cover tab receiver 35 is formed on a lower surface of the tool body 16, between the working air conduit inlet opening 32 and the hose connector 30 and is configured to receive a portion of the fan/turbine assembly 20, as will be presently described.

Referring to FIGS. 3 and 4, the recovery tank assembly 18 comprises a recovery tank 36 and a suction nozzle 38 in communication with the recovery tank 36 via a recovery tank inlet 40. The recovery tank 36 comprises a generally cylindrical peripheral wall 42 having a closed bottom 44 and forms a recovery chamber 46 in which recovered cleaning fluid and dirt passing through the suction nozzle 38 is received via the recovery tank inlet 40. Multiple recesses 48 are formed in the upper edge of the peripheral wall 42 and form exhaust outlets 50 when the recovery tank 34 is mounted to the fan/turbine assembly 20. Preferably, one or both of the recovery tank 36 and the suction nozzle 38 are translucent or transparent to allow the contents to be at least partially visible to the user. The recovery tank 36 is removably mounted to the fan/turbine assembly 20 and can be removed therefrom to empty the contents of the recovery chamber 46 after a cleaning operation is complete.

The suction nozzle 38 comprises a rear nozzle body 52, which, as illustrated, is integrally formed with the recovery tank 36 and a front nozzle body 54 removably mounted to the rear nozzle body 52 to form a fluid flow path 56 therebetween. In another embodiment (not illustrated), the front nozzle body 54 is not removable from the rear nozzle body 52. In yet another embodiment (not illustrated), the recovery tank 36 is removable from the suction nozzle 38. The fluid flow path 56 extends between a suction nozzle opening 58, which, in operation, is positioned adjacent the surface to be cleaned, and the recovery tank inlet 40.

The rear nozzle body 52 comprises a generally planar upper wall 60 and two spaced side walls 62 joined to a rear wall 64. The front nozzle body 54 comprises a front wall 66 having two spaced side walls 68 configured to snap-fit to the side walls 62 of the rear nozzle body 52 to releasably secure the front nozzle body 54 to the rear nozzle body 52. The front wall 66 further comprises an upper portion 70 that extends above the side walls 68 and comprises an arcuate upper surface 72. When the front nozzle body 54 is mounted to the rear nozzle body 52, the upper portion 70 extends above the upper wall 60 of the rear nozzle body 54 and the arcuate upper surface 72 conforms to the arcuate lower surface 28 of the nozzle receiver 26. The upper portion 70 further forms an area where the user can grip the front nozzle body 54 to remove it from the rear nozzle body 52. The front wall 66 further has a generally flat glide surface 74 at a lower portion thereof, adjacent the suction nozzle opening 58, which rests on the surface to be cleaned during operation and helps distribute the weight of the accessory tool 10 over a relatively large surface area so that the user may glide the accessory tool 10 over the surface to be cleaned with less exertion.

Figure 6:
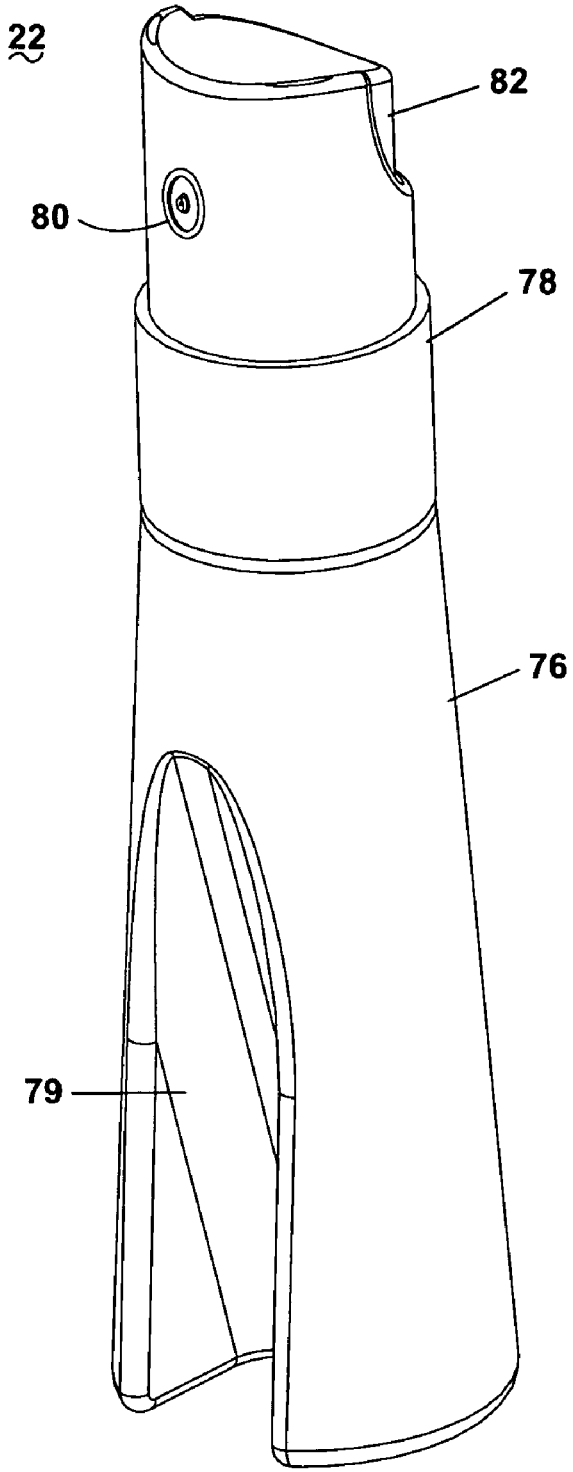
FIG. 6 is a perspective view of the fluid dispensing assembly from FIG. 2.

Referring to FIG. 6, the fluid dispensing assembly 22 can comprise any vessel that can store and distribute the cleaning fluid. As illustrated, the fluid dispensing assembly 22 comprises a cleaning fluid container 76 for storing the cleaning fluid and a manually actuable dispensing cap 78 mounted to the cleaning fluid container 76. The cleaning fluid container 76 is preferably shaped to complement the shape of the fluid dispensing assembly receiver 24, and can comprise a recessed portion 79 that can be press-fit over the ridge 31 of the fluid dispensing assembly receiver 24 to mount the fluid dispensing assembly 22 to the tool body 16. The dispensing cap 78 comprises a spray nozzle 80 for distributing cleaning fluid onto the surface of the cleaned and a conventional pump (not shown) used in non-aerosol dispensers that is operated by a movable discharge button 82. In operation, the user depresses the discharge button 82 to distribute a dose of cleaning fluid from the spray nozzle 80 onto the surface to be cleaned. The user may repeatedly depress the discharge button 82 to distribute multiple doses until a desired amount of cleaning fluid has been applied to onto the surface to be cleaned. When empty, the fluid dispensing assembly 22 can be removed, discarded and replaced with a new fluid dispensing assembly, or the fluid dispensing assembly 22 can be refilled with cleaning fluid and reused. It is understood that in some cleaning operations, the user may desire to only recover fluid from the surface to be cleaned, and in this case, cleaning fluid is not dispensed from the fluid dispensing assembly 22.

Referring to FIGS. 3 and 4, the fan/turbine assembly 20 comprises a suction fan 84 in fluid communication with the suction nozzle 38 to create suction force to draw cleaning fluid and dirt from the surface to be cleaned into the recovery tank 36, and a turbine 86 coupled to the suction fan 86 to drive the suction fan 86 using working air drawn over and through the turbine by the vacuum cleaner 14. The fan/turbine assembly 20 further comprises a suction fan cover 88, a turbine cover 90, and a separation plate 92. Together, the suction fan cover 88 and the separation plate 92 define a suction fan chamber 89 in which the suction fan 84 is received. Similarly, the turbine cover 90 and the separation plate 92 define a turbine chamber 91, which is separate from the suction fan chamber 89, in which the turbine 86 is received. The suction fan cover 88 is in turn at least partially received by the recovery tank 36 and the turbine cover 90 is mounted to the lower surface of the tool body 16 and rests upon the recovery tank 36. The suction fan 84 and the turbine 86 are rotatably mounted to the separation plate 92 by a coupling, which is illustrated herein as an axle 94 retained within a bearing 96 mounted to the separation plate 92. The axle 94 comprises two ends that pass through the bearing 96, each of which respectively mounts one of the suction fan 84 and the turbine 86.

Figure 7A:
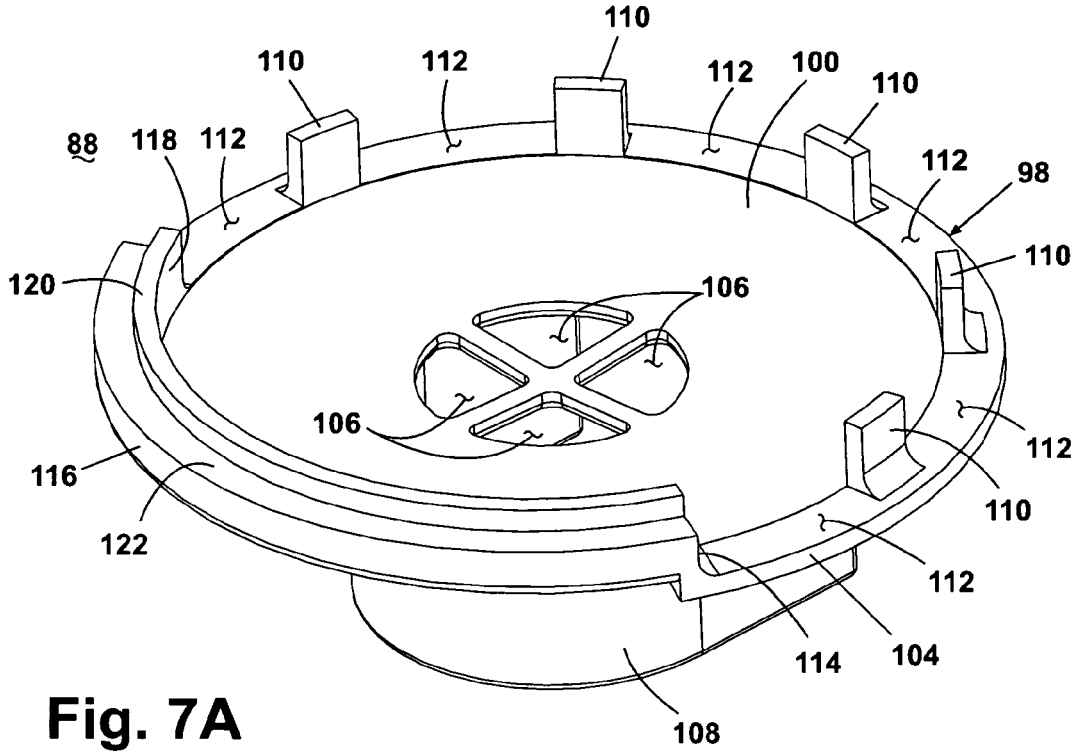
FIG. 7A is a top perspective view of a suction fan cover of the fan/turbine assembly from FIG. 2.
Figure 7B:
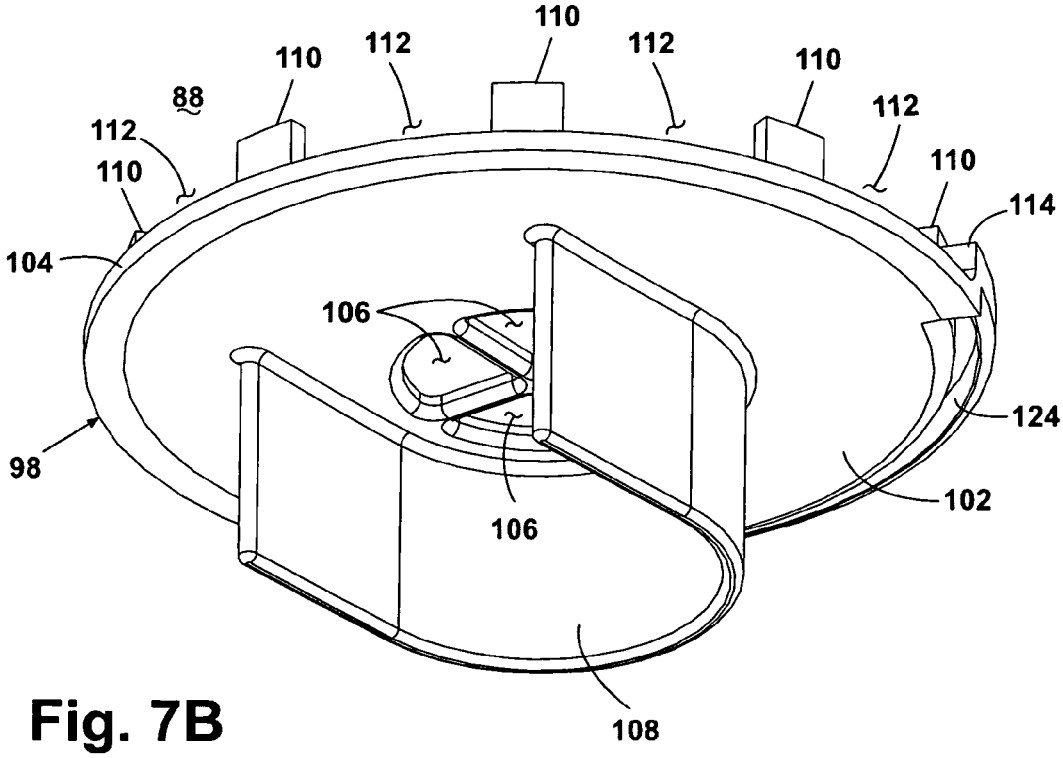
FIG. 7B is a bottom perspective view of the suction fan cover from FIG. 7A.

Referring to FIGS. 7A and 7B, the suction fan cover 88 comprises a generally flat circular body 98 having an upper surface 100, a lower surface 102, and a peripheral edge 104. At least one fan inlet opening 106 is formed in the body 98, which fluidly communicates the recovery tank 36 with the suction fan 84. As illustrated, four fan inlet openings 106 are provided. A U-shaped baffle 108 centered around the fan inlet openings 106 extends from the lower surface 102 and into the recovery chamber 46 and forms the air/liquid separator of the recovery tank 36. The baffle 108 forces air passing through the recovery tank 36 from the suction nozzle 38 to take a more circuitous path to the suction fan 84 and aids in the separation of air from recovered cleaning fluid drawn into the recovery tank 36. A plurality of spaced upstanding partitions 110 is formed on the upper surface 100 and is arranged in an arc along the periphery of one half of the body 98. The partitions 110 form fan outlets 112 therebetween that are in fluid communication with the exhaust outlets 50 when the recovery tank 34 is mounted to the fan/turbine assembly 20. Formed on the periphery of the other half of the body 98 is an upstanding arcuate wall 114. The wall 114 comprises an outer surface 116, which is continuous with the peripheral edge 104, an inner surface 118, and an upper surface 120. A step 122 is formed between the outer and upper surfaces 116, 120. An arcuate groove 124 is formed on the lower surface 102 and is generally aligned with the arcuate wall 114.

When the accessory tool 10 is assembled, the suction fan 84 is received within the area bounded by the partitions 110 and the arcuate wall 114 of the suction fan cover 88, and the suction fan cover 88 is received within the recovery tank 36. While not illustrated, the suction fan cover 88 can be provided with a float valve assembly for sealing the fan inlet openings 106 when the amount of fluid in the recovery chamber 46 rises above a certain level to insure that fluid does not enter the fan/turbine assembly 20. For example, the baffle 108 could be modified to include a float valve assembly. Alternately, the float valve assembly can be formed with the recovery tank assembly 18.

Figure 8A:
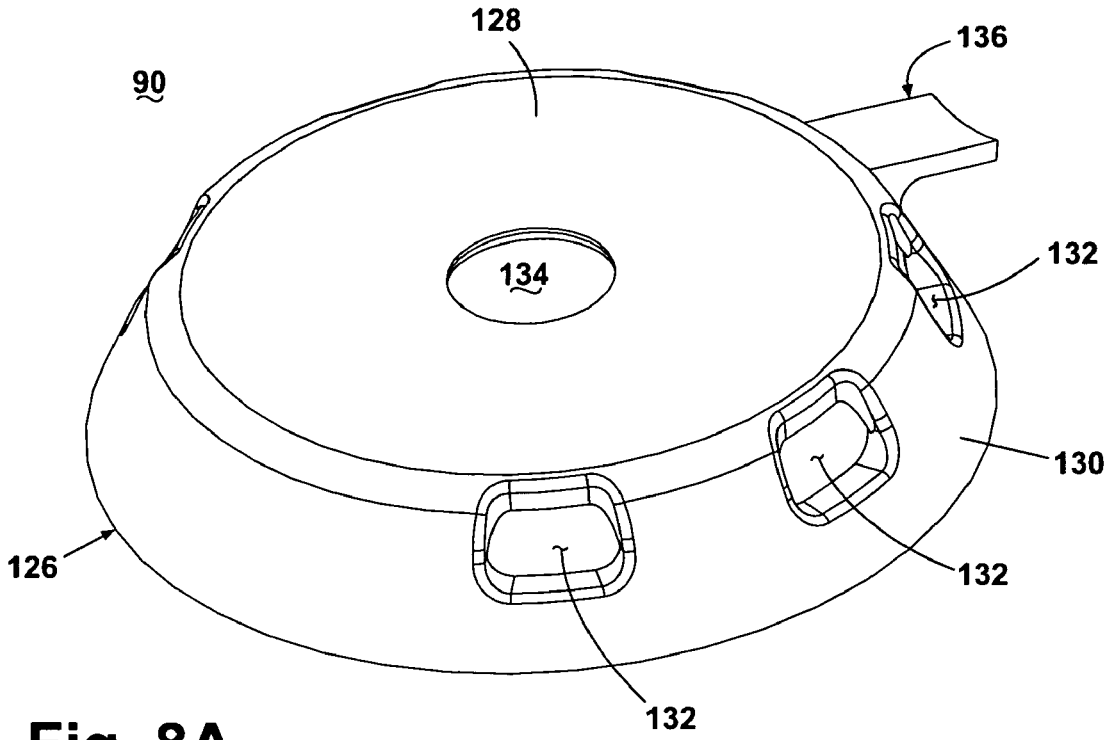
FIG. 8A is a top perspective view of a turbine cover of the fan/turbine assembly from FIG. 2.
Figure 8B:
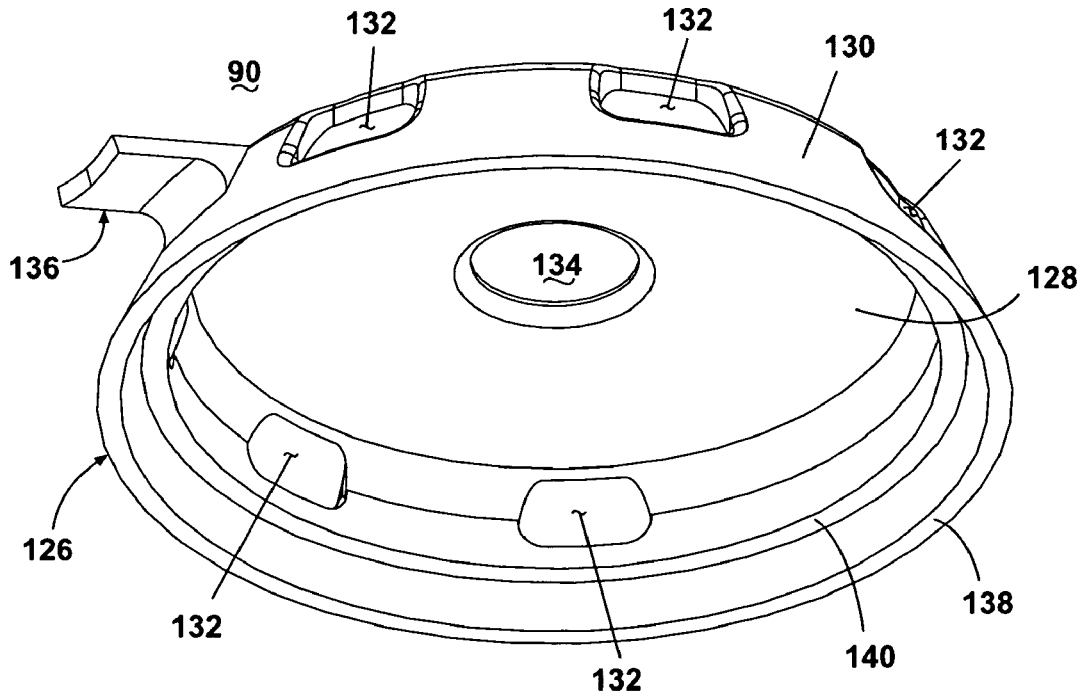
FIG. 8B is a bottom perspective view of the turbine cover from FIG. 8A.

Referring to FIGS. 8A and 8B, the turbine cover 90 comprises a dish-shaped circular body 126 having an upper wall 128 and a peripheral wall 130 depending from the upper wall 128 at an outward angle. A plurality of spaced turbine inlet openings 132 are formed in the turbine cover 90 and are preferably formed in the peripheral wall 130. At least one turbine outlet opening 134 is formed in the upper wall 128, which is generally aligned with the working air conduit inlet opening 32 of the tool body 16 and fluidly communicates the turbine 86 with the working air conduit 34. A tab 136 extends from the body 126, near the junction between the upper wall 128 and the peripheral wall 130, and is received by the tab receiver 35 on the tool body 16 to mount the turbine cover 90, which can optionally be pre-assembled with the fan/turbine assembly 20 and the recovery tank assembly 18, to the tool body 16. The peripheral wall 130 further comprises a generally planar lower surface 138 and a generally planar inner step 140, which is spaced from the lower surface 138 and formed below the turbine inlet openings 132. When the accessory tool 10 is assembled, the lower surface 138 rests atop the peripheral wall 42 of the recovery tank 36 and the inner step 140 rests atop the separation plate 92.

Figure 9A:
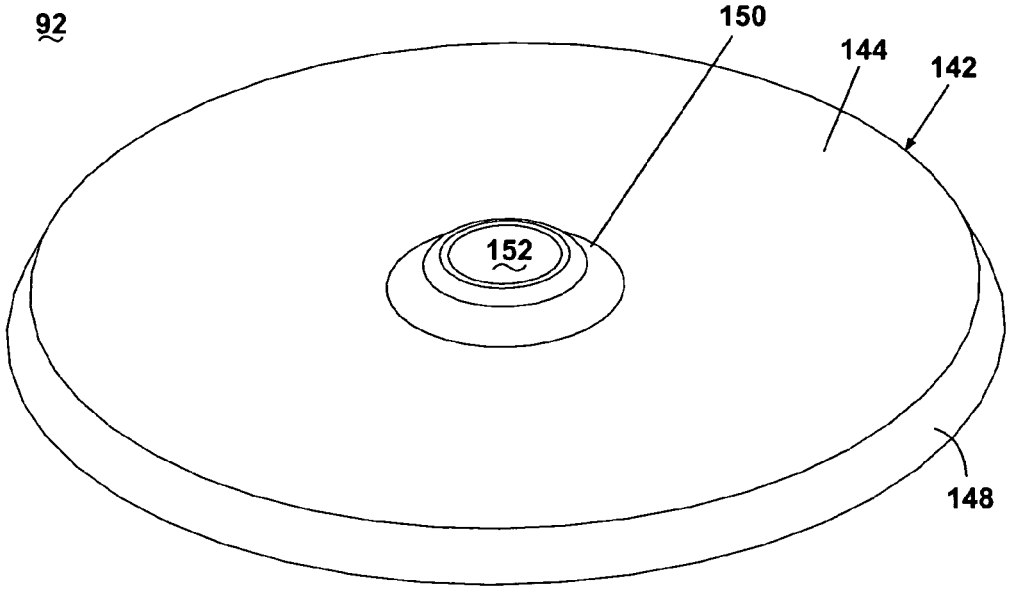
FIG. 9A is a top perspective view of a separation plate of the fan/turbine assembly from FIG. 2.
Figure 9B:
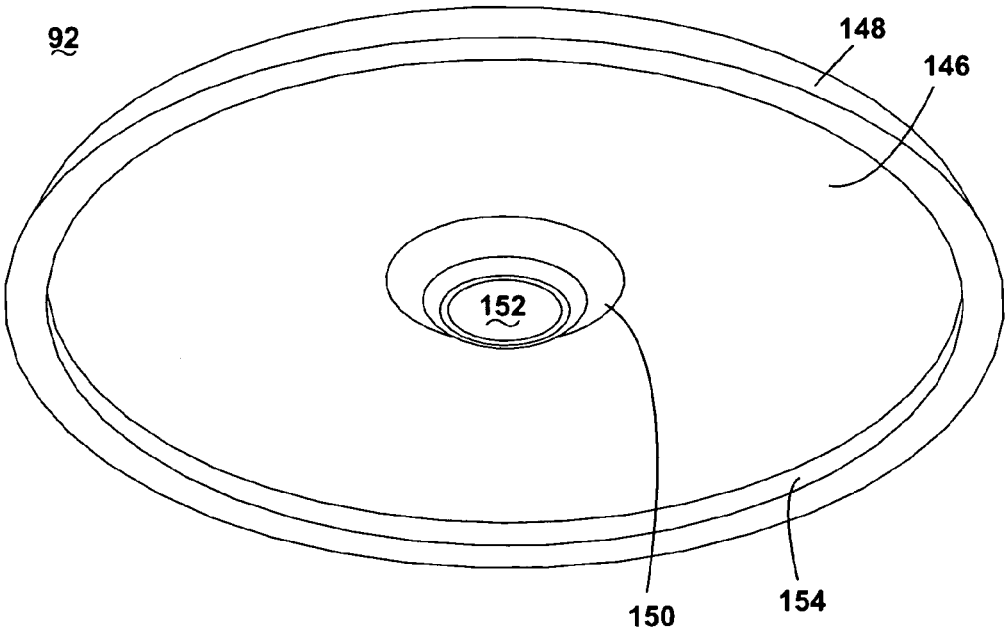
FIG. 9B is a bottom perspective view of the separation plate from FIG. 9A.

Referring to FIGS. 3, 9A and 9B, the separation plate 92 comprises a generally flat circular body 142 having an upper surface 144, a lower surface 146, and a peripheral edge 148 that angles outwardly from the upper surface 144 to the lower surface 146. A central hub 150 protrudes from the upper and lower surfaces 144, 146 and comprises a bearing opening 152 passing therethrough. The bearing 96 is received within the bearing opening 152 and in turn mounts the axle 94. A depending rim 154 is formed around the periphery of the lower surface 146 and is continuous with the peripheral edge 148. When the accessory tool 10 is assembled, the rim 154 abuts the partitions 110 and the step 122 in the arcuate wall 114 of the suction fan cover 88.

Figure 10A:
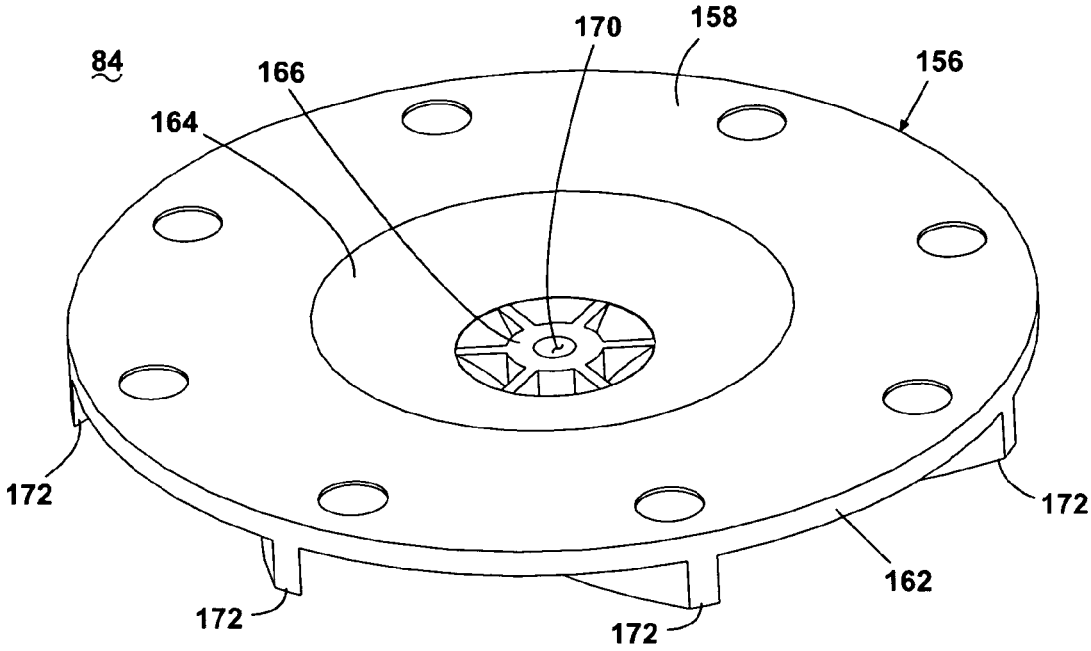
FIG. 10A is a top perspective view of a suction fan of the fan/turbine assembly from FIG. 2.
Figure 10B:
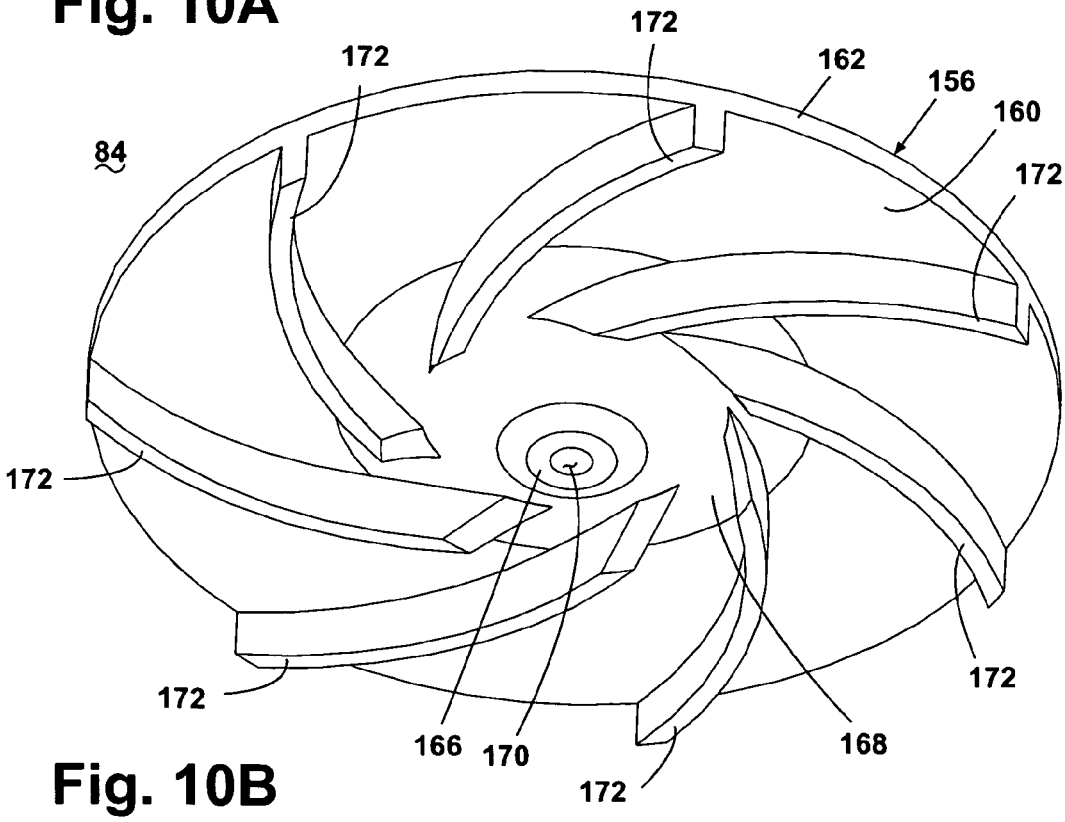
FIG. 10B is a bottom perspective view of the suction fan from FIG. 10A.

Referring to FIGS. 10A and 10B, the suction fan 84 comprises a generally circular body 156 having an upper surface 158, a lower surface 160, and a peripheral edge 162. The upper surface 158 is generally flat near the peripheral edge 162 and tapers to a central depression 164 in which a hub 166 is provided. The lower surface 160 is also generally flat near the peripheral edge 162 and tapers to a central protrusion 168 which continues the hub 166. An axle opening 170 passes through the hub 166 and receives the axle 94 to rotatably couple the suction fan 84 with the turbine 86. A plurality of arcuate fan blades 172 extend radially outwardly from the hub 166 to the peripheral edge 162 and are generally equally spaced from one another.

Figure 11A:
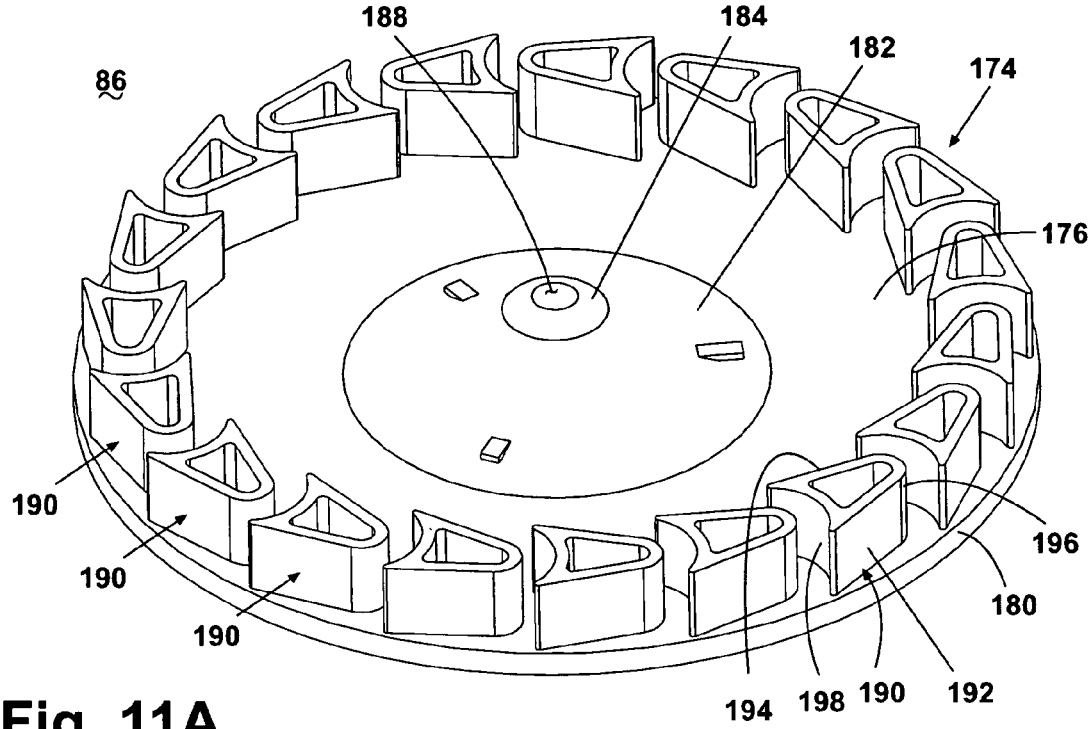
FIG. 11A is a top perspective view of a turbine of the fan/turbine assembly from FIG. 2.
Figure 11B:
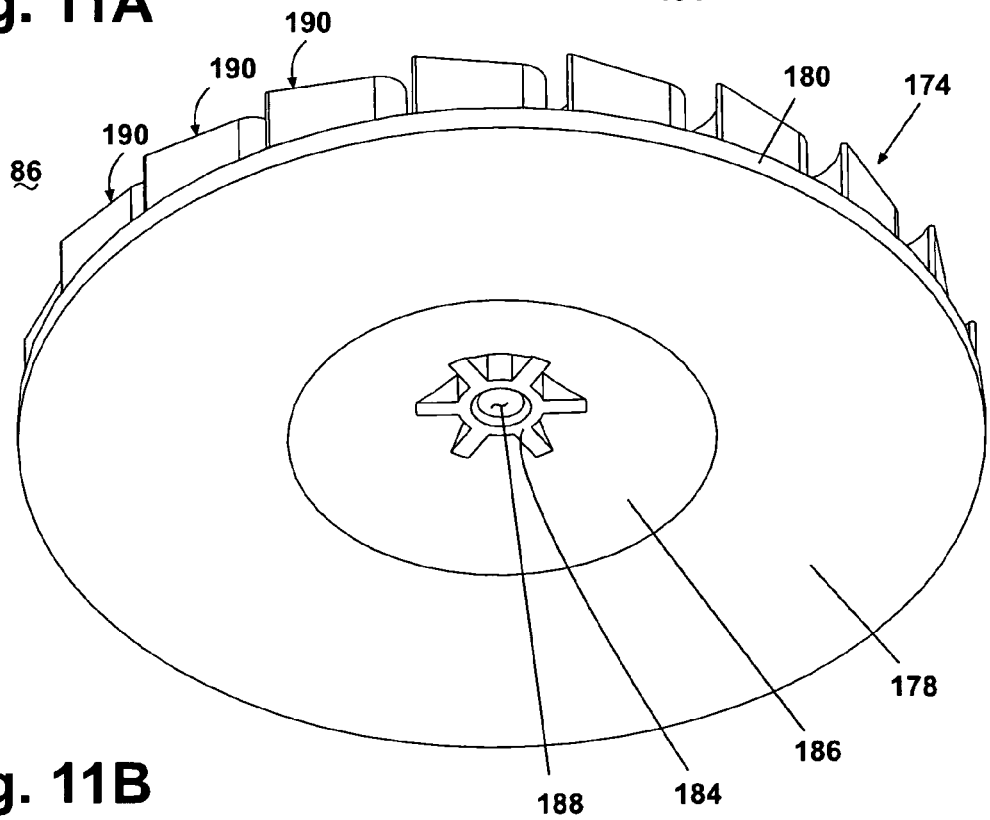
FIG. 11B is a bottom perspective view of the turbine from FIG. 11A.

Referring to FIGS. 11A and 11B, the turbine 86 comprises a generally circular body 174 having an upper surface 176, a lower surface 178, and a peripheral edge 180. The upper surface 176 is generally flat near the peripheral edge 180 and tapers to a central protrusion 182 on which a hub 184 is located. The lower surface 178 is also generally flat near the peripheral edge 180 and tapers to a central depression 186 in which the hub 184 is located. An axle opening 188 passes through the hub 184 and receives the axle 94 to rotatably couple the turbine 86 with the suction fan 84. A plurality of turbine blades 190 are provided on the upper surface 176 and are generally positioned a ring orientation near the peripheral edge 180. Each turbine blade 190 is generally triangular in shape when view from above, and comprises an outer straight segment 192 joined to a similar inner straight segment 194 by a rounded tip segment 196, with an arced segment 198 positioned opposite the rounded tip segment 194 joining the outer and inner straight segments 192, 194. As illustrated, the turbine blades 190 are hollow, which reduces the weight of the turbine 86 and saves material; however, the turbine 86 can alternately be formed with solid blades, which would increase the weight of the turbine 86 near the peripheral edge 180, thereby increasing the angular momentum of the turbine 86.

In operation, when the turbine blades 190 are exposed to a moving air stream, such as that created by the vacuum cleaner 14, the axle 94 rotates with the turbine blades 190. Specifically, the exposure of the arced segment 198 of the turbine blades 190 to a moving air stream causes the turbine body 174, and consequently the axle 94, to rotate. The rotation of the axle 94 cases the suction fan 86 to rotate. As the suction fan 84 rotates, the fan blades 172 pull air from the recovery chamber 46 through the fan openings 106, thereby creating a partial vacuum within the recovery tank 36 and suction nozzle 38 and suction at the suction nozzle opening 58.

Figure 12:
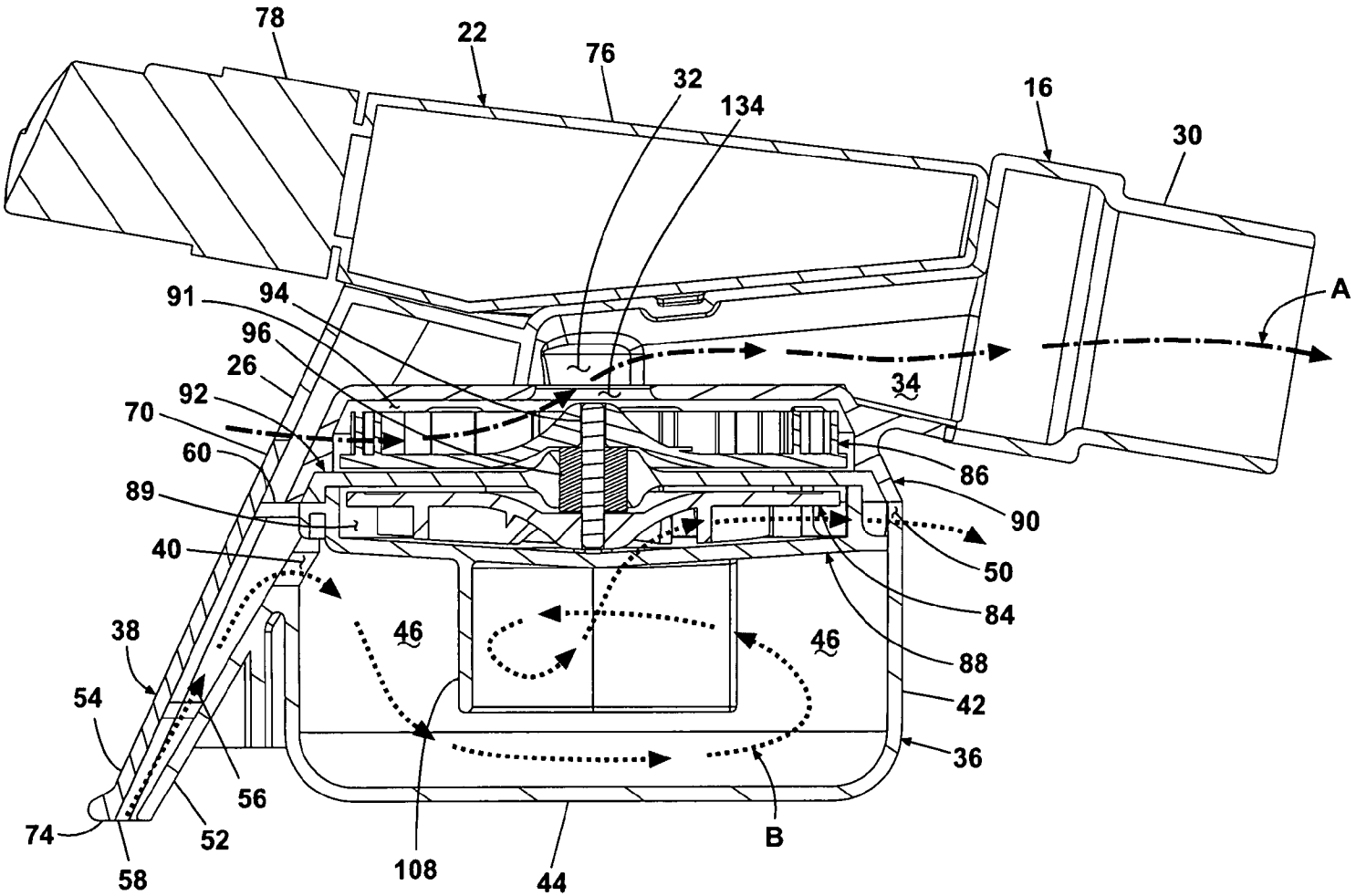
FIG. 12 is a sectional view similar to FIG. 4, illustrating the airflow pathways through the accessory tool.
Figure 13:
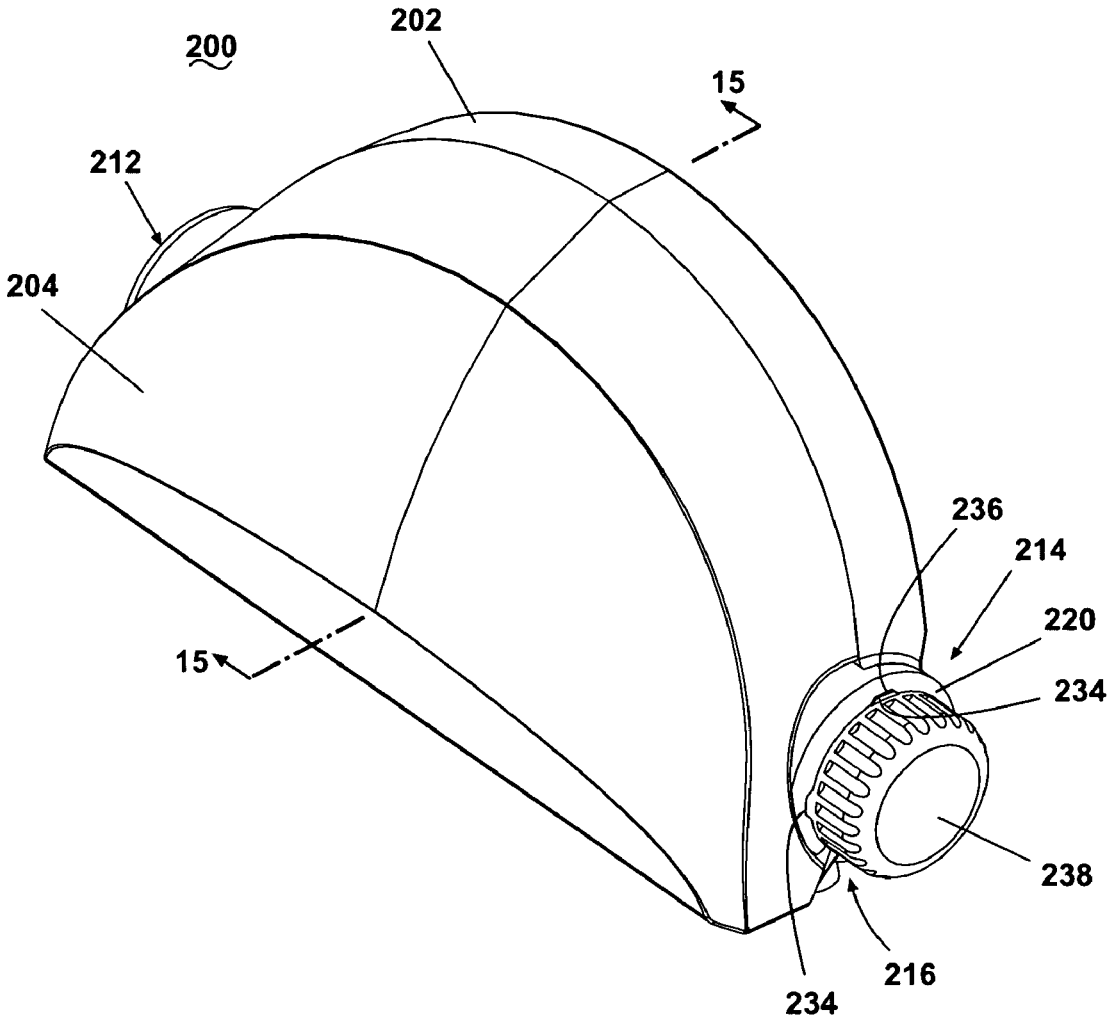
FIG. 13 is a top perspective view of a second embodiment of a nozzle assembly for the accessory tool according to the present invention, where the nozzle assembly comprises a suction nozzle and a movable agitator assembly.
Figure 14:
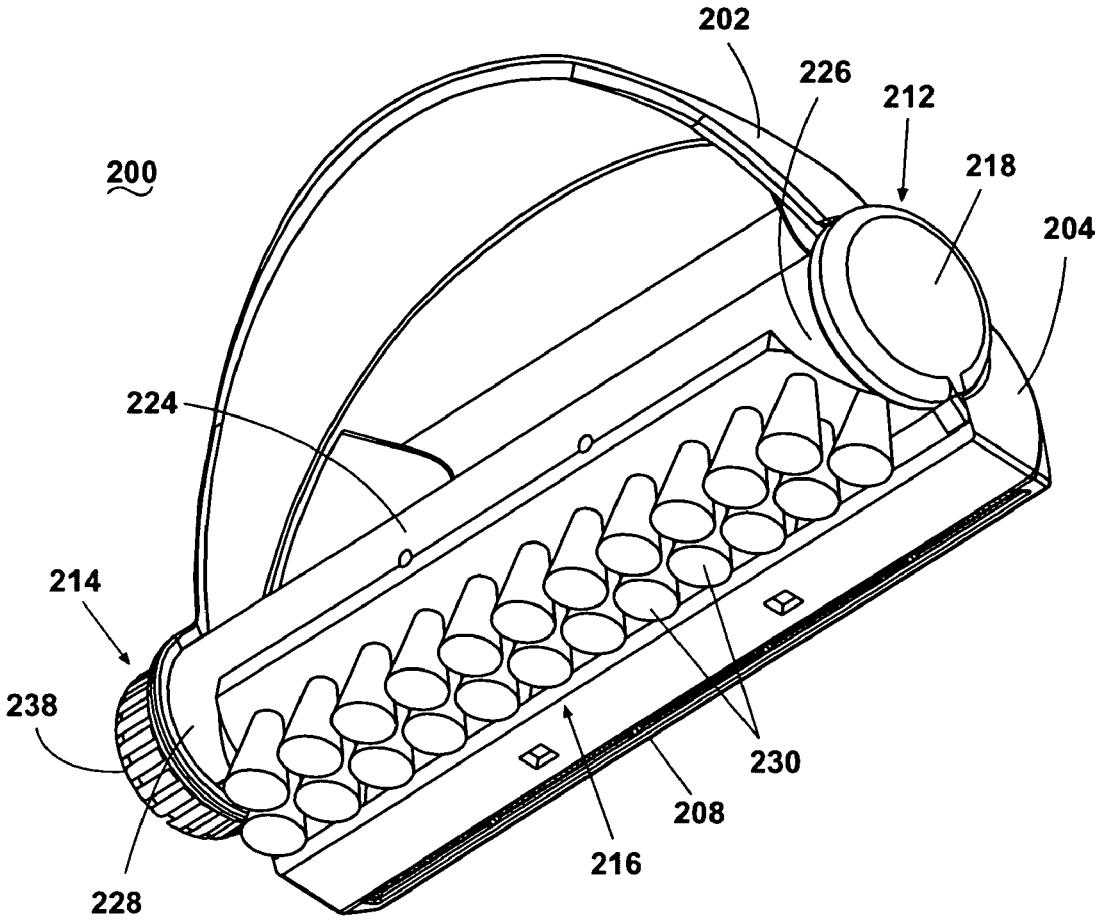
FIG. 14 is a bottom perspective view of the nozzle assembly from FIG. 13.
Figure 15:
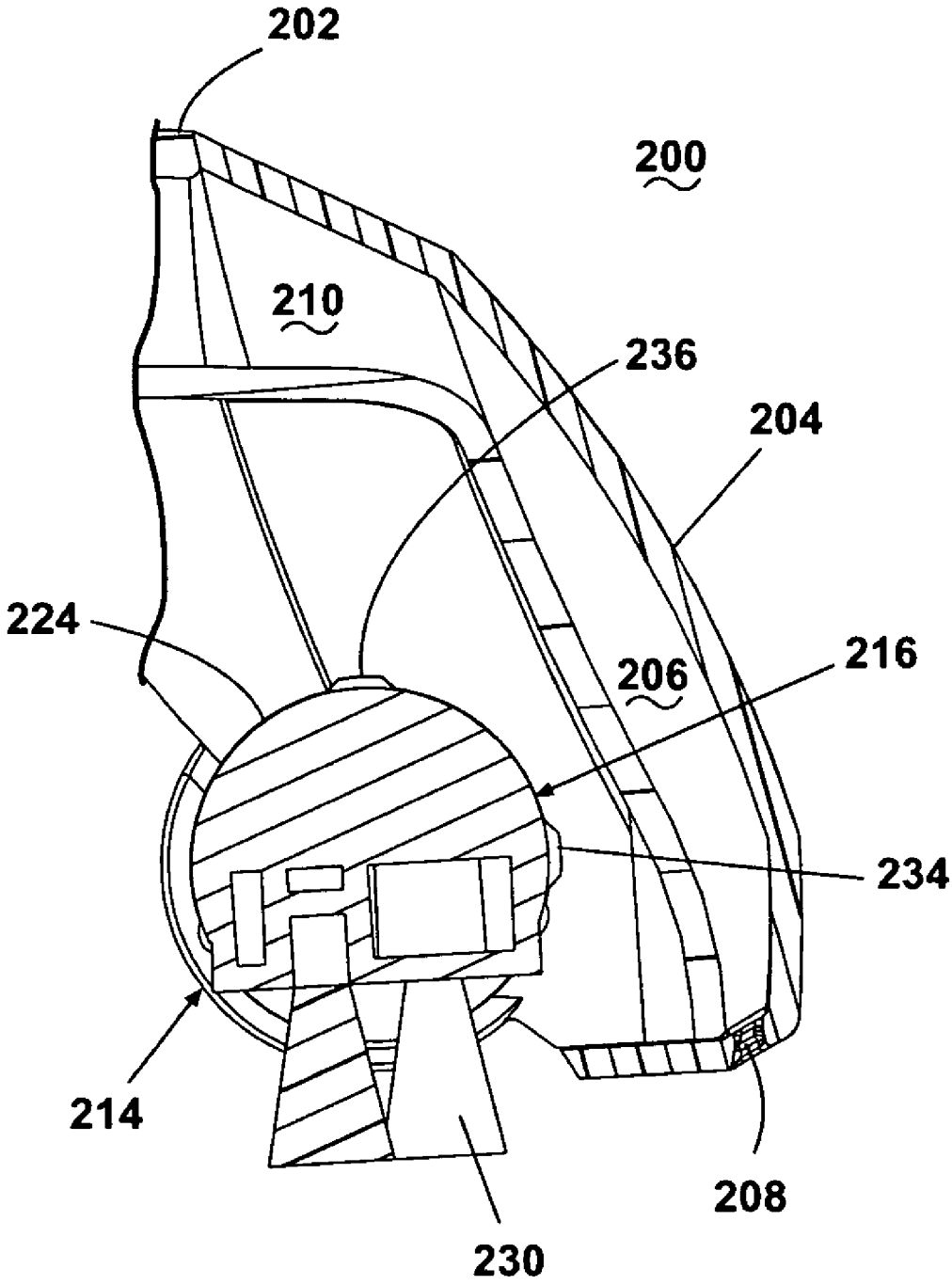
FIG. 15 is a sectional view taken through line 15-15 of FIG. 13.
Figure 16:
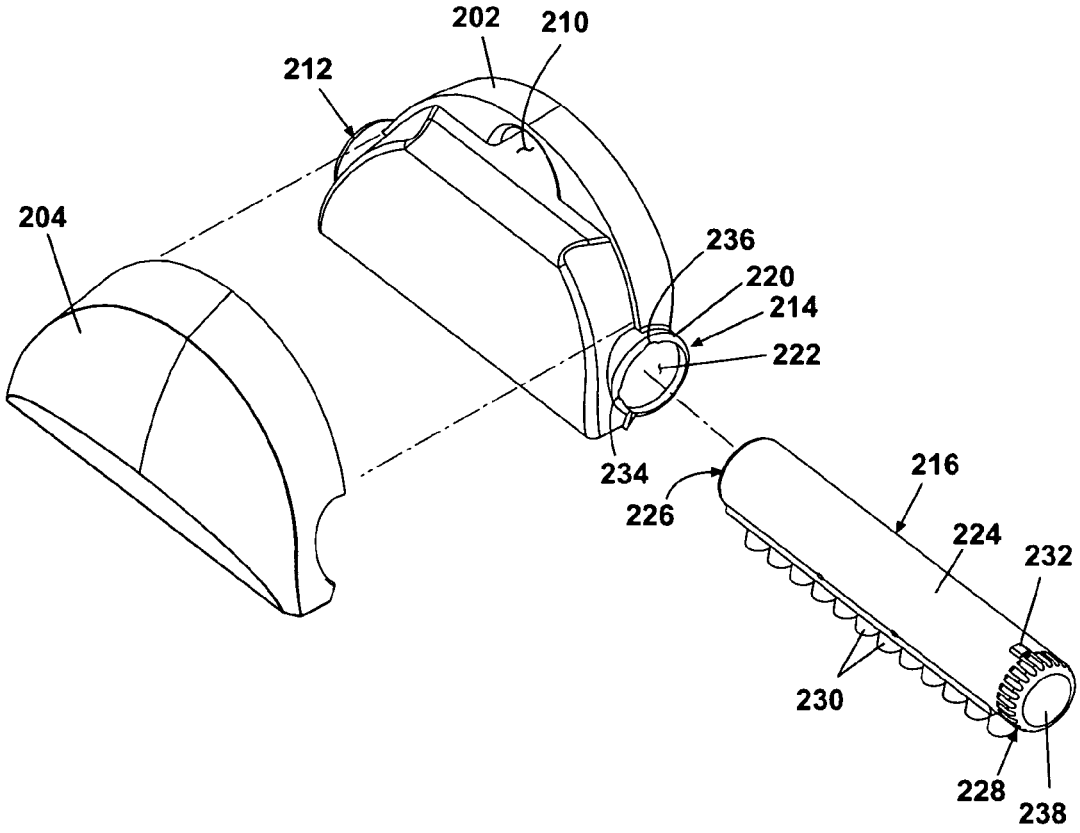
FIG. 16 is an exploded view of the nozzle assembly from FIG. 13.

Referring to FIG. 12, the airflow pathway though the accessory tool 10 is illustrated. Arrow A indicates the "dry" portion of the pathway, where air enters the turbine chamber 91 through the turbine inlet openings 132 (shown in FIG. 2) and passes through and over the turbine 86, thereby providing motive force thereto. The air then passes out of the fan/turbine assembly 20 through the turbine outlet opening 134 and into the working air conduit 34 via the working air conduit inlet opening 32. From the working air conduit 34, the air passes sequentially through the vacuum hose 12 and the vacuum cleaner 14.

Arrow B indicates the "wet" portion of the pathway, where recovered cleaning fluid and dirt enters the suction nozzle 38 and is collected in the recovery tank 36. Some air also enters the suction nozzle 38, and passes around the baffle 108 and into the suction fan chamber 89 via the fan inlet openings 106 (shown in FIG. 7A). The air then passes through and over the suction fan 84, passes out of the fan/turbine assembly 20 via the fan outlets 112, and is exhausted from the accessory tool 10 through the recovery tank air outlets 50.

Because the suction fan 84 and the turbine 86 are contained within separate chambers 89, 91, fluid from the wet portion of the pathway B is prevented from entering the vacuum cleaner 14 through the dry portion of the airflow pathway A. Furthermore, a seal (not shown) can be use at the bearing to prevent fluid from getting into the bearing 96, and potentially into the dry portion of the pathway A.

In a variation of the embodiment of the accessory tool of FIGS. 1- 12, at least some of the main operating components of the accessory tool can be arranged along a generally non-vertical axis relative to the tool body, rather than a generally vertical axis. For example, at least some of the main operating components, such as the fan/turbine assembly 20, can be arranged along a generally horizontal axis. Benefits of arranging the operating components of the accessory tool along a non-vertical axis can include increased fluid capacity in the fluid dispensing assembly 22 and/or the recovery tank 36, and flexibility with regard to the overall aesthetic shape. Furthermore, the airflow pathway through the accessory tool can be reshaped to eliminate one or more 90 degree bends in either the "dry" or "wet" portion of the pathway, which can offer improved performance.

Referring to FIGS. 13-16, an alternative nozzle assembly 200 for the accessory tool according to the invention is illustration. While not specifically shown, the nozzle assembly 200 can be substituted for the suction nozzle 38 on the recovery tank assembly 18. Furthermore, the nozzle assembly 200 can be employed on other cleaning tools and apparatus. The nozzle assembly 200 comprises a rear nozzle body 202, which may or may not be integrally formed with a recovery container, such as recovery tank 36, and a front nozzle body 204 removably mounted to the rear nozzle body 202 to form a fluid flow path 206 therebetween. In another embodiment (not illustrated), the front nozzle body 204 is not removable from the rear nozzle body 202. The fluid flow path 206 extends between a suction nozzle opening 208, which, in operation, is positioned adjacent the surface to be cleaned, and an inlet 210 that fluid communicates with a recovery container, such as recovery tank 36.

A pair of agitator retainers 212, 214 is formed on either side of the rear nozzle body 202 and moveably mounts an agitator assembly 216. The first agitator retainer 212 comprises a closed end wall 218, while the second agitator retainer 214 comprises an end wall 220 having an opening 222 formed through which the agitator assembly 216 can be inserted during assembly of the nozzle assembly 200.

The agitator assembly 216 comprises a generally cylindrical agitator body 224 having a first end 226 that is mounted within the first agitator retainer 212 and a second end 228 that is mounted within the second agitator retainer 214. An agitator surface, such as bristles 230, is provided on the agitator body 224 between the first and second ends 226, 228 for scrubbing or otherwise agitating the surface to be cleaned. The bristles 230 can be sufficiently resilient so that they deform to allow the agitator assembly 216 to be inserted through the opening 222. A locking projection or detent 232 is formed on the agitator body 224 and is received in one of two spaced locking slots 234, 236 formed adjacent the opening 222 on the second agitator retainer 214. As illustrated, the first locking slot 234 is generally formed at the nine o'clock position with respect to the opening 222, and the second locking slot 236 is generally formed at the twelve o'clock position with respect to the opening 222, such that the locking slots 234, 236 are spaced roughly 90° apart. However, the locking slots 234, 236 can be positioned at many different orientations with respect to each other.

Figure 17:
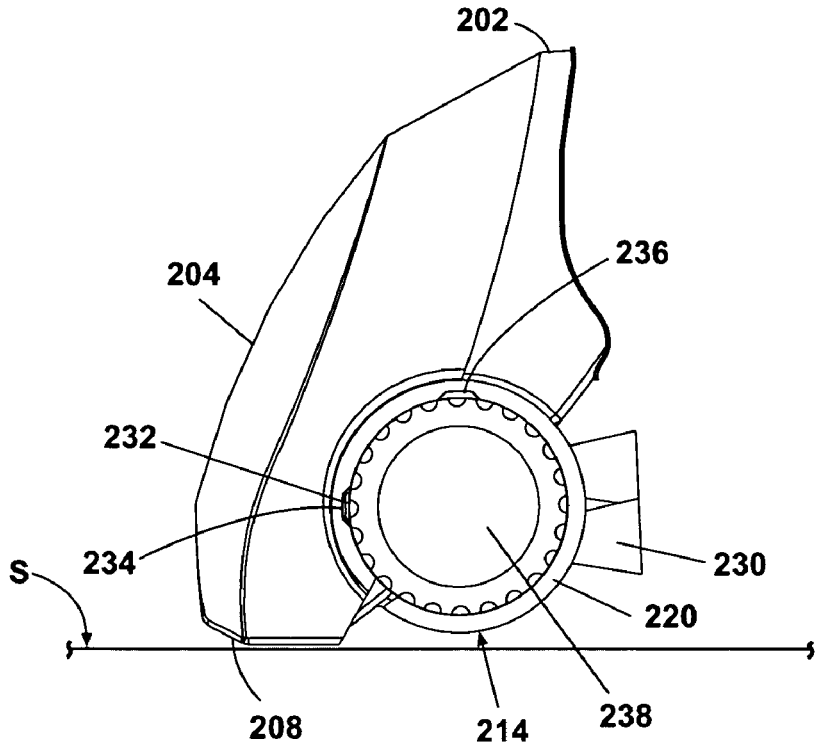
FIG. 17 is a side view of the nozzle assembly from FIG. 13, showing the nozzle assembly in a first use orientation where the suction nozzle is positioned adjacent the surface to be cleaned and the agitator assembly is rotated away from the suction to be cleaned.
Figure 18:
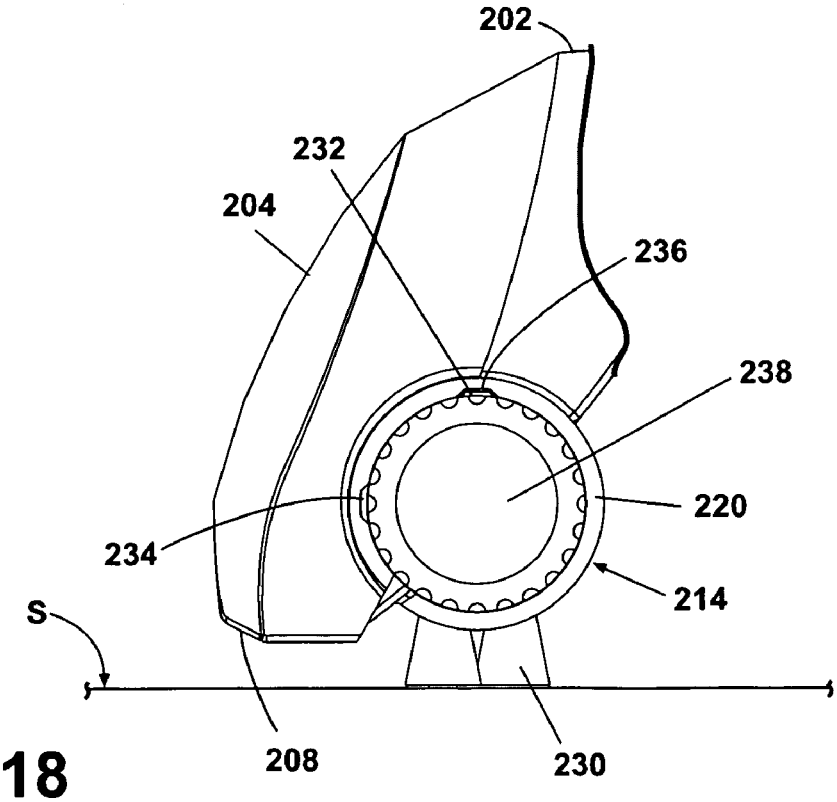
FIG. 18 is a side view of the nozzle assembly from FIG. 13, showing the nozzle assembly in a second use orientation where the suction nozzle is moved away from the surface to be cleaned and the agitator assembly is rotated to a position adjacent the surface to be cleaned.

Referring to FIG. 17, when the locking projection 232 is received within the first locking slot 234, the nozzle assembly 200 is in a first use orientation in which the suction nozzle opening 208 is positioned adjacent the surface to be cleaned S and the agitator assembly 216 is positioned with the bristles 230 away from the suction to be cleaned S. The first use orientation corresponds to an extraction mode of the accessory tool, where the accessory tool can recover fluid and dirt from the surface to be cleaned S. Referring to FIG. 18, when the locking projection 232 is received within the second locking slot 236, the nozzle assembly 200 is in a second use orientation in which the suction nozzle opening 208 is moved away from the surface to be cleaned S and the agitator assembly 216 is positioned with the bristles 230 adjacent the surface to be cleaned S. The second use orientation corresponds to a scrubbing mode of the accessory tool, where the accessory tool can agitate the surface to be cleaned S after the application of cleaning solution. A knob 238 for moving the agitator assembly 216 between the first and second use orientations is provided on the second end 228 of the agitator body 224 and projects exteriorly of the second agitator retainer 214 to be easily accessible to the user for manual actuation.

To move the agitator assembly 216 from the first to the second use orientation, the agitator body 224 is rotated, preferably using the knob 238, in a clockwise direction with respect to the orientation of FIG. 17 and 18 so that the locking projection 232 emerges from the first locking slot 234 and is recaptured in the second locking slot 236. This requires a roughly 90° rotation as illustrated. A similar method is used to move the agitator assembly 216 back to the first use orientation.

The rotatable agitator assembly 215 allows the extraction mode to be separated from the scrubbing mode. The position of the bristles 230 in scrubbing mode (FIG. 18) spaces the suction nozzle opening 208 from the surface to be cleaned to keep fluid from being extracted before it is agitated.

Figure 19:
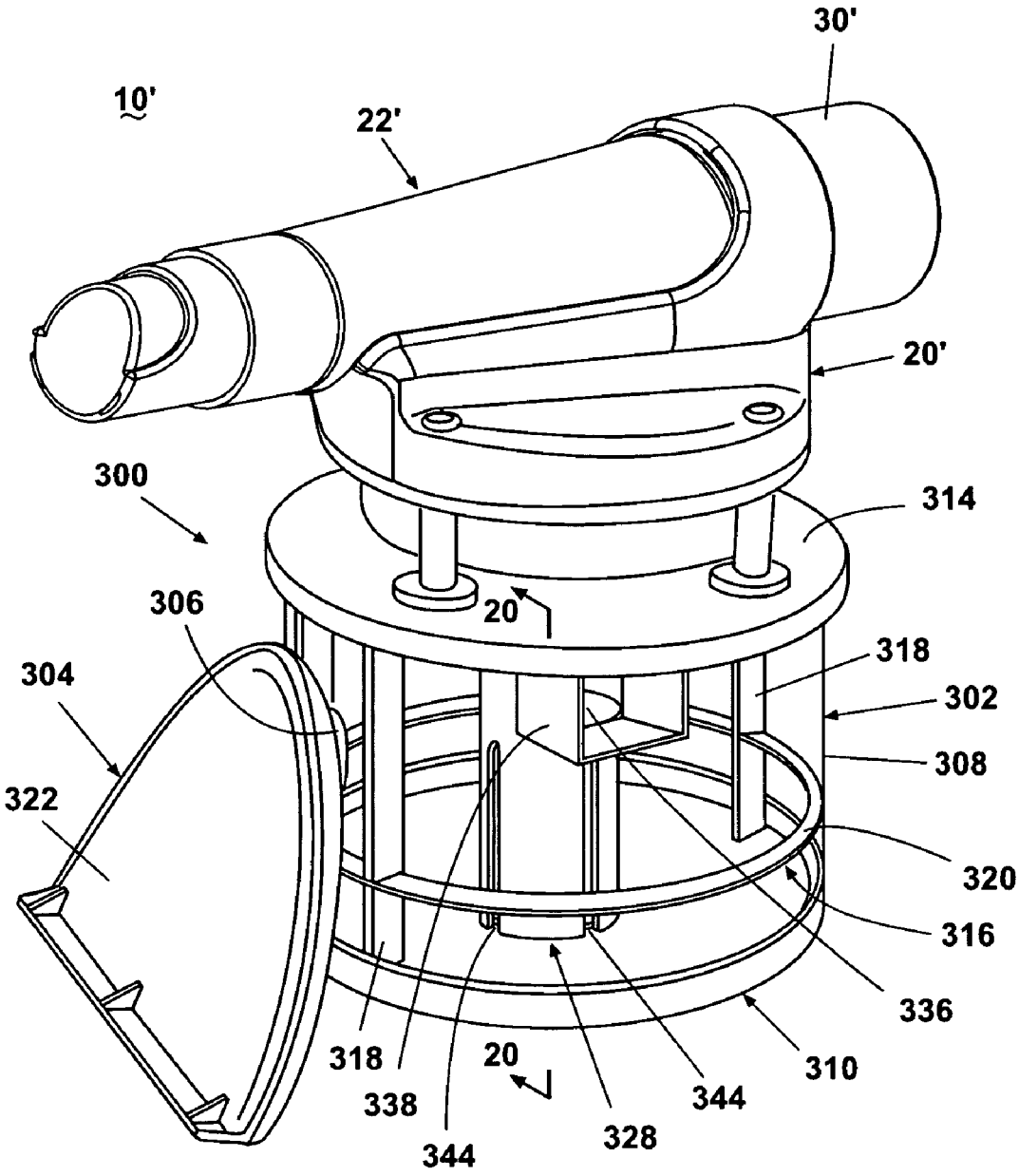
FIG. 19 is a perspective view of a second embodiment of a recovery tank assembly for the accessory tool according to the present invention.
Figure 20:
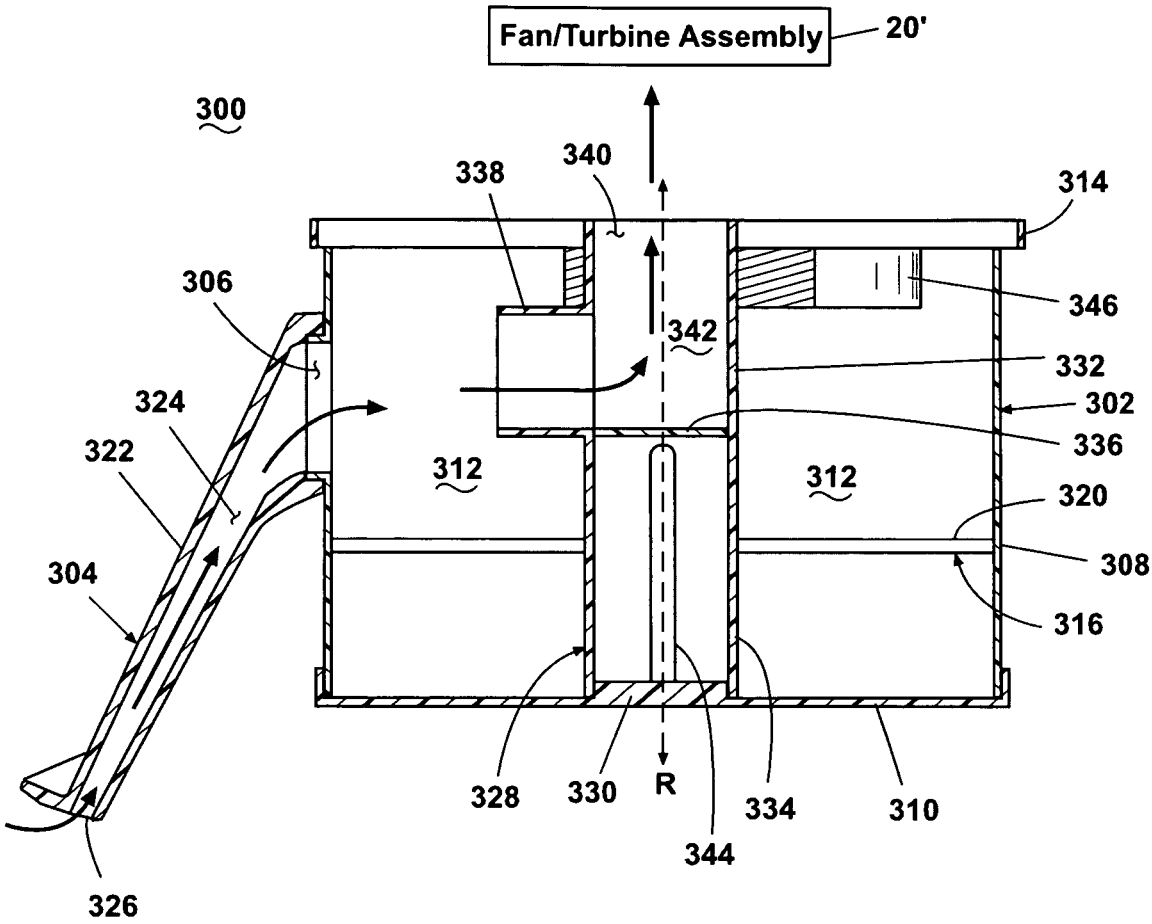
FIG. 20 is a sectional view taken through line 20-20 of FIG. 19.

Referring to FIG. 19, an alternative recovery tank assembly 300 for the accessory tool 10' according to the invention is illustrated. The recovery tank assembly 300 can be substituted for the recovery tank assembly 18 on the accessory tool 10, and like elements of the accessory tool 10 are designated by the same reference numerals bearing a prime symbol (').

Furthermore, the recovery tank assembly 300 can be employed on other cleaning tools and apparatus. While illustrated slightly differently, components of the accessory tool 10' other than the recovery tank assembly 300 can be assumed to be the same as described above.

The recovery tank assembly 300 comprises a recovery tank 302 and a suction nozzle 304 in communication with the recovery tank 302 via a recovery tank inlet 306. The recovery tank 302 comprises a generally cylindrical peripheral wall 308 having a closed bottom 310, and forms a recovery chamber 312 in which recovered cleaning fluid and dirt passing through the suction nozzle 304 is received via the recovery tank inlet 306. The recovery tank 302 is removably mounted to a tank cap 314, which is fixedly attached to the fan/turbine assembly 20' and can be removed therefrom to empty the contents of the recovery chamber 312 after a cleaning operation is complete. Preferably, one or both of the recovery tank 302 and the suction nozzle 304 are translucent or transparent to allow the contents to be at least partially visible to the user.

Optionally, the recovery tank 302 further includes a support frame 316 that adds rigidity to the recovery tank 302 and can comprise multiple vertical pieces 318 extending along the peripheral wall 308 from the closed bottom 310 to the tank cap 314 that are joined by a circular piece 320 extending around the inside circumference of the peripheral wall 308.

The suction nozzle 304 comprises a one-piece nozzle body 322 integrally formed with the recovery tank 302. The nozzle body 322 is hollow to form a fluid flow path 324 extending between a suction nozzle opening 326, which, in operation, is positioned adjacent the surface to be cleaned, and the recovery tank inlet 306.

A hollow rotating column 328 configured for 360° rotation about an axis of rotation R is provided within the recovery chamber 312 and is coupled with a bearing plate 330 formed on the interior side of the closed bottom 310 of the recovery tank 302. The column 328 is divided into an upper section 332 and a lower section 334 by a horizontal wall 336 formed in the hollow interior of the column 328. An air exit 338 is formed in the upper section 332 and fluidly communicates the recovery chamber 312 with a recovery tank outlet 340 formed in the tank cap 314 via an air flow path 342 defined by air exit 338 and the upper section 332. The recovery tank outlet 340 is in fluid communication with the fan/turbine assembly 20'. The lower section 334 comprises at least one opening 344 through the column 328 to allow water to enter the hollow interior of the lower section 334. As illustrated, four such openings 334 are provided, but only two of the openings 334 are visible in FIG. 19.

Figure 21:
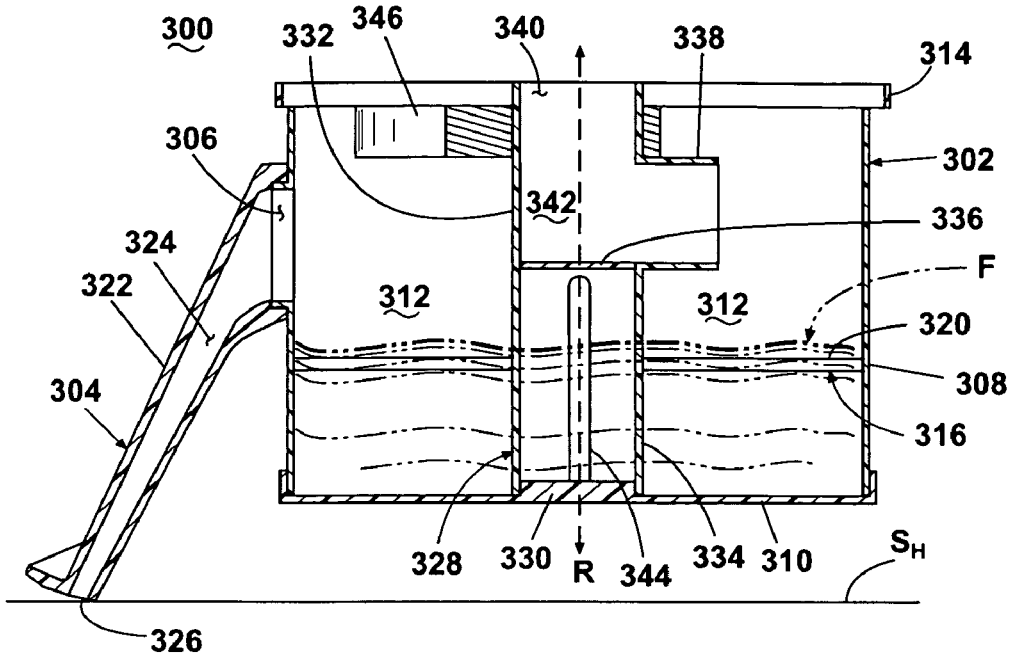
FIG. 21 is a side view of the recovery tank assembly from FIG. 19, showing the partially-full recovery tank assembly in a first use orientation.
Figure 22:
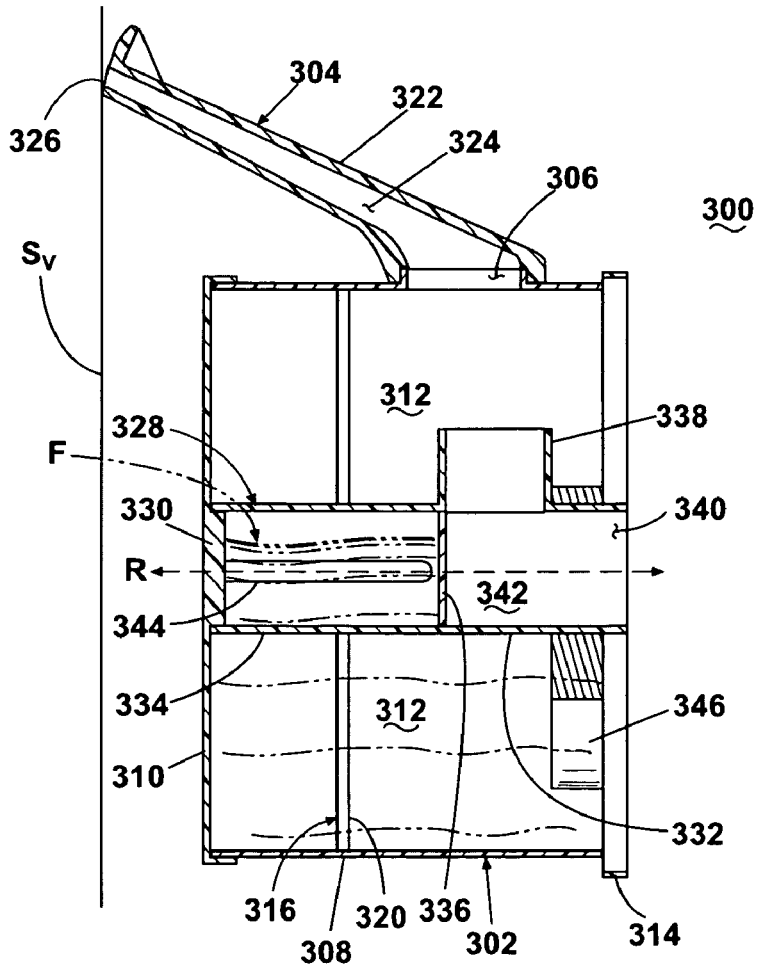
FIG. 22 is a side view of the recovery tank assembly from FIG. 19, showing the partially full recovery tank assembly in a second use orientation.

Referring additionally to FIGS. 21 and 22, the column 328 is configured to rotate so that the air exit 338 is above a level of fluid F in the recovery chamber 312 when the axis of rotation in non-vertical. In other words, the air exit 338 will have an upward orientation when the recovery tank assembly 300 is tilted from a typical position, shown in FIG. 21, used when cleaning a generally horizontal surface to be cleaned $S_H$ to a position used when cleaning a non-horizontal surface to be cleaned. An example of such a position is shown in FIG. 22, where the surface to be cleaned $S_V$ is generally vertical. The column 328 can be weighted to effect this rotation. As illustrated, the upper section 332 comprises a weight 346 that encircles the column 328, but that has a majority of its weight distributed on the opposite side of the column 328 as the air exit 338. As the recovery tank assembly 300 is tilted from the use position shown in FIG. 21, gravity forces the weight 346 downward to its lowest possible orientation, causing the column 328 to rotate and orient the air exit upward to its highest possible orientation. As shown in FIG. 22, the horizontal wall 336 prevents fluid from entering the air flow path 342 when the recovery tank 302 is tilted. This allows more fluid to be stored in the recovery chamber 312. While only two use orientations are illustrated, it can be appreciated that any number of different use orientations are possible.

The arrangement of the recovery tank assembly 300 allows the accessory tool 10' to be held and used in many different orientations without liquid inadvertently being ingested into the fan/turbine assembly 20', as well as maximizing the amount of fluid that can be contained in the recovery chamber 312. While not illustrated, the rotating air exit can be applied to other cleaning tools and apparatus, and it is contemplated that the rotating air exit 338 can be used in other diverse applications.

Figure 23:
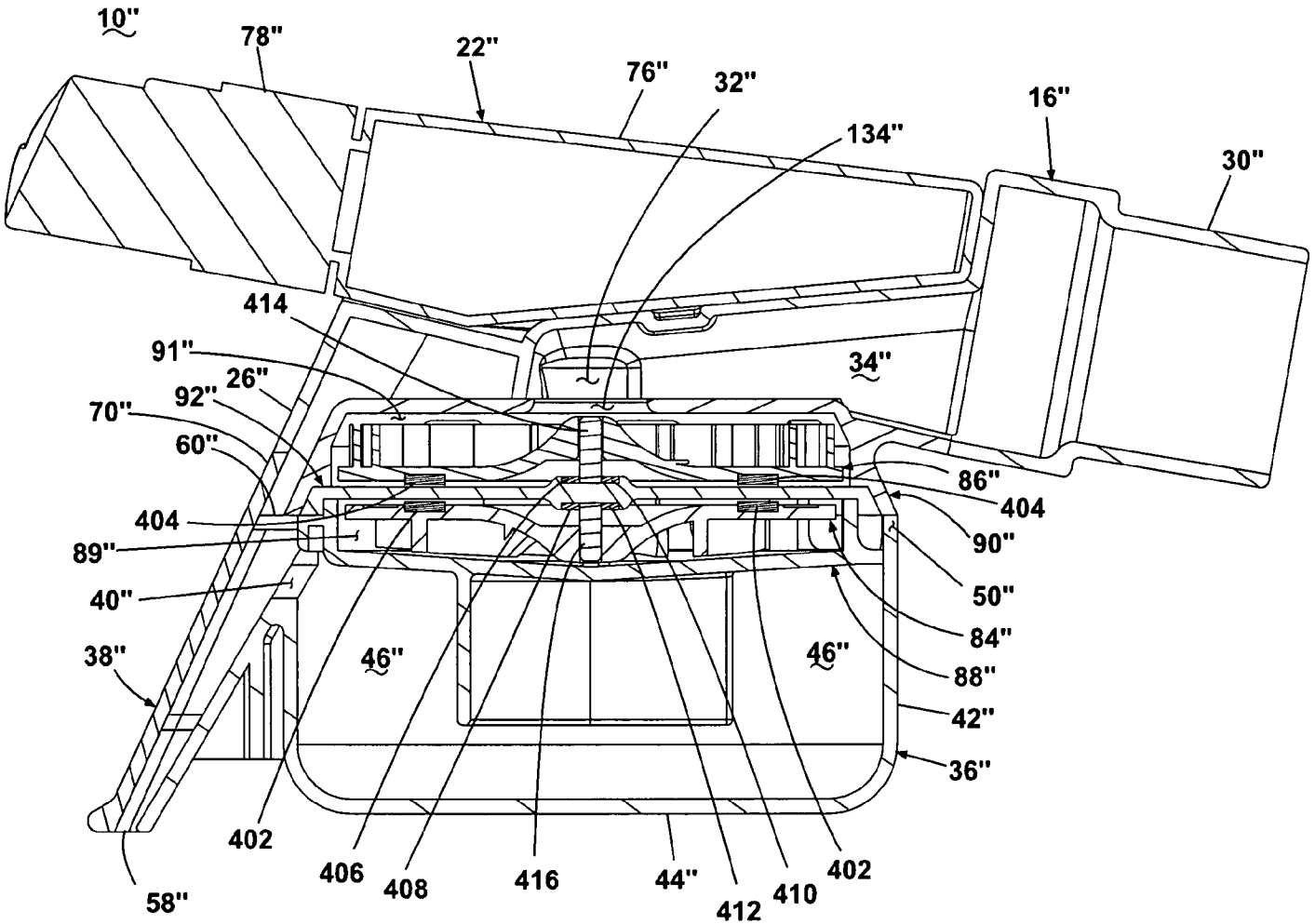
FIG. 23 is a sectional view of the accessory tool according to the present invention, comprising a second embodiment of a fan/turbine assembly according to the present invention.
Figure 24:
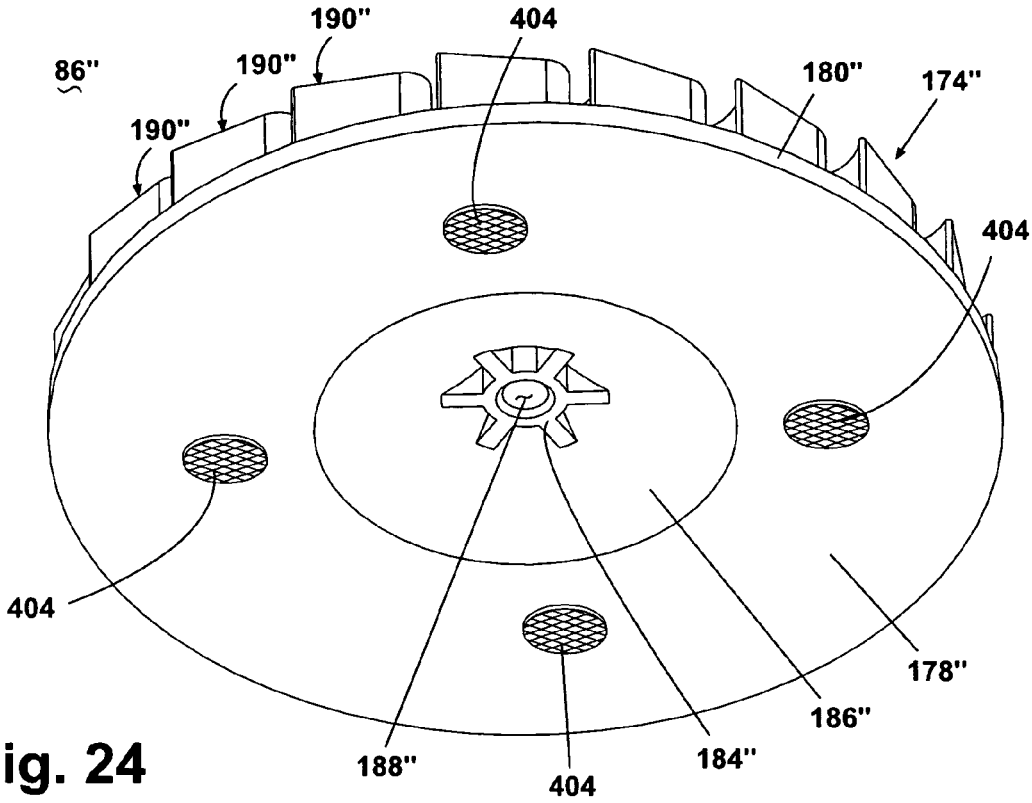
FIG. 24 is a bottom perspective view of a turbine of the fan/turbine assembly from FIG. 23.
Figure 25:
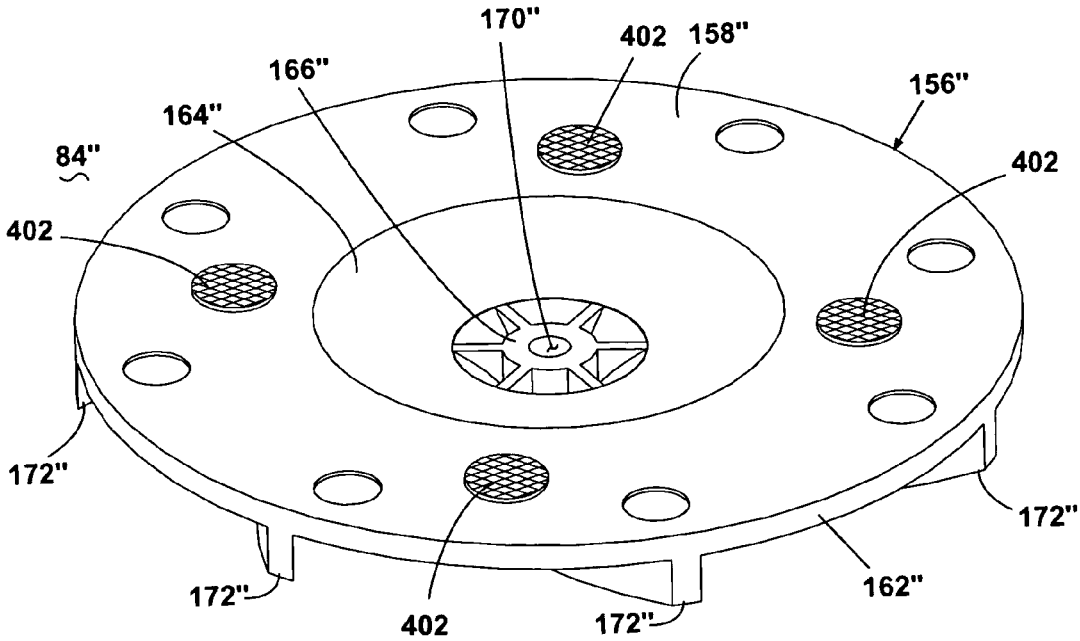
FIG. 25 is a top perspective view of the suction of the fan/turbine assembly from FIG. 23.

Referring to FIGS. 23-25, a alternative fan/turbine assembly 400 for the accessory tool 10" according to the invention is illustrated. The fan/turbine assembly 400 is substantially similar to the fan/turbine assembly 20, with some exceptions. The fan/turbine assembly 400 can be substituted for the fan/turbine assembly 20 on the accessory tool 10", and like elements of the accessory tool 10" are designated by the same reference numerals bearing a double prime symbol (''). Furthermore, the fan/turbine assembly 400 can be employed on other cleaning tools and apparatus.

The suction fan 84" is not directly physically coupled with the turbine 86", but rather is magnetically coupled with the turbine 86" through the separation plate 92". The suction fan 84" comprises at least one magnet 402 on its lower surface 178" and the turbine 86" comprises at least one magnet 404 on its upper surface 158". Preferably, the suction fan 84" and the turbine 86" each comprise multiple magnets 402, 404 spaced from each other. As illustrated, four magnets 402, 404 spaced at 90° intervals are provided on the suction fan 84" and the turbine 86".

Accordingly, the separation plate 92" does not include a through opening, and the suction fan 84" and the turbine 86" are separately rotatably mounted within the suction fan chamber 89" and the turbine chamber 91". As illustrated, the separation plate 92" comprises opposing bearing seats 406, 408 on its upper and lower surfaces 144, 146, respectively. Each bearing seat 406, 408 receives a bearing 410, 412 which in turn mounts a turbine axle 414 and a fan axle 416, respectively. The turbine axle 414 is received by the axle opening 170" of the turbine 86" and the fan axle 416 is received by the axle opening 188" of the suction fan 84".

In operation, when the turbine 86" is exposed to a moving air stream, such as that created by the vacuum cleaner 14, the turbine 86" will rotate with the turbine axle 414. The circular movement of the turbine magnets 404 generates a magnetic field which causes the suction fan magnets 402 to move correspondingly, and, consequently the suction fan 84" to rotate about the suction fan axle 416. As the suction fan 84" rotates, a partial vacuum is created within the recovery tank 36" and suction nozzle 38" and suction is created at the suction nozzle opening 58".

Since the suction fan 84" and the turbine 86" have separate bearings and axles, maintenance and replacement of parts can be performed separately. Furthermore, since the separation plate 92" does not have a through opening, the need for an expensive seal at the bearing 412 is negated, and the separation of the dry and wet portions of the airflow pathway is more clearly defined.

The concept of a magnetically-coupled suction/drive system can be applied to other cleaning tools and apparatus. For example, the concept can be applied to a vacuum cleaning appliance having a motor-driven suction fan. A suction motor having a motor shaft is retained within a first enclosure and the suction fan is retained within a second enclosure that is separate from the first enclosure. The suction fan is rotatably mounted within the second enclosure and is magnetically coupled with the motor shaft.

Figure 26:
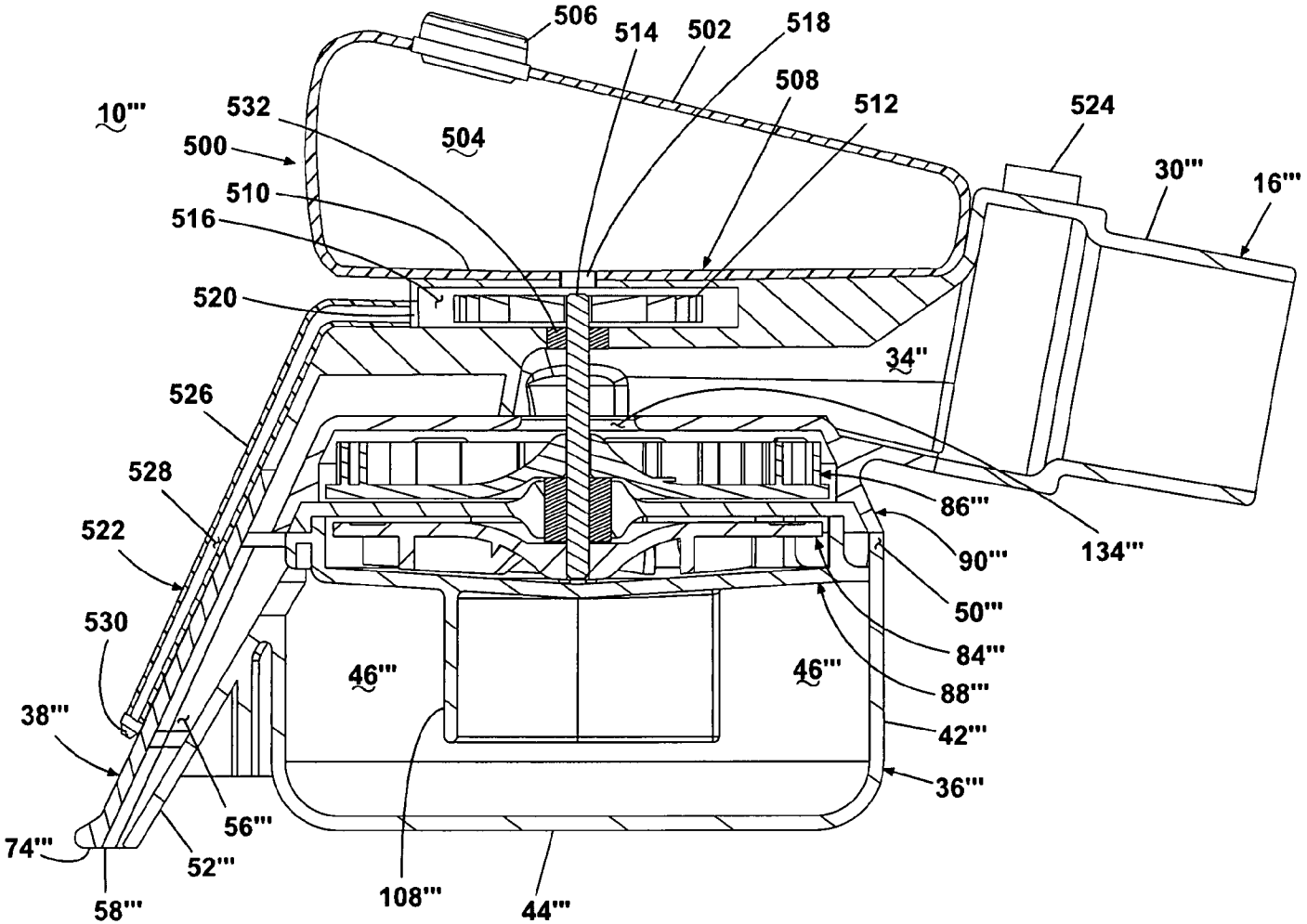
FIG. 26 is a sectional view of an accessory tool according to another embodiment of the invention comprising a fluid dispensing assembly having a turbine-driven pump.

Referring to FIG. 26, a sectional view of an accessory tool 10''' according to another embodiment of the invention is shown, and comprises an alternate fluid dispensing assembly 500. The fluid dispensing assembly 500 can be substituted for the fluid dispensing assembly 22 on the accessory tool 10, and like elements of the accessory tool 10 are designated by the same reference numerals bearing a triple prime symbol ('''). Furthermore, the fluid dispensing assembly 500 can be employed on other cleaning tools and apparatus.

The fluid dispensing assembly 500 comprises a removable fluid reservoir 502 defining a fluid chamber 504 in which cleaning fluid is stored before it is distributed onto the surface to be cleaned. The cleaning fluid can comprise any suitable cleaning fluid, including, but not limited to, water, concentrated detergent, diluted detergent, and the like. The fluid reservoir 502 includes a removable cap 506 that is removed to fill the fluid chamber 504 with cleaning fluid. Optionally, the fluid reservoir 502 can be a single-use container that is discarded when empty and replaced with a new fluid reservoir 502.

The fluid dispensing assembly 500 further comprises a turbine-driven fluid pump 508 for dispensing cleaning fluid from the fluid reservoir 502. The fluid pump 508 can comprise any common fluid pump suitable for being driven by the turbine 86'''. As illustrated, the fluid pump 508 includes a pump housing 510 formed on the tool body 16''' which houses a pump fan 512 rotatably coupled with the turbine 86''' by an axle 514. The axle 514 also couples the suction fan 84''' with the turbine 86''', as previously described for the first embodiment of the accessory tool. A seal 532 is provided about the axle 514 to prevent fluid from leaking out of the fluid pump 508 and into the working air conduit 34'''. While only one turbine 86''' is illustrated, the accessory tool 10''' can alternately be provided with separate turbines for the suction fan 84''' and the fluid pump 508.

The pump housing 510 defines a pump chamber 516 in which cleaning fluid from the fluid reservoir 502 can be received, in addition to the pump fan 512. The pump housing 510 comprises an inlet 518 to the pump chamber 516 that is in communication with the fluid reservoir 502 when it is received in the tool body 16''', and an outlet from the pump chamber 516 that is in communication with a fluid distributor. The fluid reservoir 502 preferably comprises a common dry disconnect coupling (not shown) that is in communication with the inlet 518 when the fluid reservoir 502 is seated on the tool body 16''', so that cleaning fluid will flow from the fluid reservoir 502 by gravity feed.

The outlet of the pump housing 510 preferably comprises a fluid flow controller 520, such as a solenoid valve or a mechanical valve, that allows pressurized fluid to flow from the pump chamber 516 to a fluid distributor 522 upon actuation of the fluid flow controller 520, which can be effected using an electrical or mechanical coupling between the fluid flow controller 520 and a user-accessible actuator 524. The user-accessible actuator 524 is preferably provided on the tool body 16''' near the hose connector 30''', which provides a convenient place for the user to grip the accessory tool 10''' while being able to selectively press the actuator 524 using the thumb or finger of the gripping hand. The fluid distributor 522 comprises a fluid conduit 526 extending along the suction nozzle 38''' that defining a fluid flow path 528 between the fluid flow controller 520 and a spray nozzle 530 positioned to spray fluid onto the surface to be cleaned, forwardly of the suction nozzle 38'''.

In operation, when the turbine 86''' is exposed to a moving air stream, such as that created by the vacuum cleaner 14, the axle 514 rotates with the turbine. The rotation of the axle 514 cases the pump fan 512. The suction fan 86''' also rotates, as previously described. As the pump fan 512 rotates, the cleaning fluid in the pump chamber 516 is pressurized. Pressing the actuator 524 opens the fluid flow controller 520, allowing pressurized cleaning fluid to flow from the pump chamber 516, through the fluid flow path 528, and onto the surface to be cleaned, via the spray nozzle 530.

The accessory tool according to any of the above embodiments can expand the cleaning capability of a conventional dry floor surface cleaning appliance by allowing the dry vacuum cleaner to be used to distribute cleaning fluid as well as recover fluid. The accessory tool can also be used with a wet extraction cleaning appliance for both distributing and recovering fluid. The accessory tool is designed such that the water recovery path is separated and isolated from the conventional working air path of the vacuum cleaning appliance to prevent water laden working air from entering the vacuum cleaning appliance. Other embodiments of the accessory tool not specifically shown herein are possible. For example, the accessory tool can include an agitating surface, such as a scrubbing pad or a brush. The agitating surface can further be configured for movement, and can be coupled with the turbine to provide motive power thereto.

While the invention has been specifically described in connection with certain specific embodiments thereof, it is to be understood that this is by way of illustration and not of limitation, and the scope of the appended claims should be construed as broadly as the prior art will permit. For example, while the figures describe a device with the main operating components arranged along a generally vertical axis relative to the tool body, it is understood that the components can be arranged along a generally horizontal axis or at any angle therebetween.

What is claimed is:

1. An accessory tool for use in connection with a vacuum cleaner, comprising:

a housing having a suction opening adapted to be connected to a vacuum hose;

a suction nozzle;

a recovery tank in fluid communication with the suction nozzle;

a turbine rotatably mounted within a turbine chamber having an inlet opening in fluid communication with the atmosphere and an outlet opening connected to the suction opening for rotatably driving the turbine with suction from the vacuum hose;

a suction fan rotatably mounted within a suction fan chamber having an inlet opening in fluid communication with the suction nozzle through the recovery tank for depositing fluid that is drawn in through the suction nozzle into the recovery tank and an outlet opening in fluid communication with the atmosphere; and a coupling between the turbine and the suction fan, whereby the turbine drives the suction fan when suction is applied at the suction opening.

2. The accessory tool from claim 1 and further comprising a fluid dispensing assembly for distributing cleaning fluid onto a surface to be cleaned.

3. The accessory tool from claim 2, wherein the fluid dispensing assembly comprises a fluid pump driven by the turbine.

4. The accessory tool from claim 1 and further comprising an agitator assembly associated with the suction nozzle and rotatably mounted with respect to the suction nozzle for movement between a first position in which the agitator is in contact with a surface to be cleaned and the suction nozzle is spaced from the surface to be cleaned, and a second position in which the suction nozzle is in contact with the surface to be cleaning and the agitator is spaced from the surface to be cleaned.

5. The accessory tool from claim 1, and further comprising an outlet conduit mounted for rotation within the recovery tank about an axis of rotation and having an inlet opening in fluid communication with the recovery tank and an outlet opening in fluid communication with the suction fan chamber, wherein the outlet conduit is constructed to rotate so that the inlet opening will have a upward orientation when the axis of rotation is non-vertical and so that the inlet opening will be above a level of fluid in the recovery tank.

6. The accessory tool from claim 1, wherein the coupling between the turbine and the suction fan is a magnetic coupling.

7. The accessory tool from claim 1, wherein the turbine and suction fan are oriented along a generally vertical axis.

8. The accessory tool from claim 1 and further comprising a separator plate that separates the turbine chamber from the suction fan chamber.

9. The accessory tool from claim 1, wherein the recovery tank comprises an air/liquid separator for separating air from liquid drawn into the recovery tank through the suction nozzle.

10. An accessory tool for use in connection with a vacuum cleaner, comprising:

a housing having a suction opening adapted to be connected to a source of suction;

a suction nozzle;

a recovery tank in fluid communication with the suction nozzle; and an outlet conduit mounted for rotation within the recovery tank about an axis of rotation and having an inlet opening in fluid communication with the recovery tank and an outlet opening in fluid communication with the source of suction;

wherein the outlet conduit is constructed to rotate so that the inlet opening will have a upward orientation when the axis of rotation is non-vertical and so that the inlet opening will be above a level of fluid in the recovery tank.

11. The accessory tool from claim 10, wherein the outlet conduit comprises a weight in opposing relation to the inlet opening.

12. The accessory tool from claim 10, wherein the inlet opening is transverse to the axis of rotation.

13. The accessory tool from claim 12, wherein the outlet opening is coaxial with the axis of rotation.

* * * * *